US008101688B2

(12) United States Patent
Kimura et al.

(10) Patent No.: US 8,101,688 B2
(45) **Date of Patent: *Jan. 24, 2012**

(54) POLYLACTIC ACID FIBER YARN PACKAGE, AND TEXTILE PRODUCTS

(75) Inventors: Toshiaki Kimura, Okazaki (JP); Shuichi Nonaka, Mishima (JP); Takashi Ochi, Miahima (JP); Takaaki Mihara, Mishima (JP); Katsuhiko Mochizuki, Mishima (JP); Yuhei Maeda, Yokohama (JP)

(73) Assignee: TORAY Industries., Inc., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/929,139

(22) Filed: Jan. 3, 2011

(65) Prior Publication Data

US 2011/0165370 A1 Jul. 7, 2011

Related U.S. Application Data

(63) Continuation of application No. 10/525,092, filed as application No. PCT/JP03/11135 on Sep. 1, 2003, now abandoned.

(30) Foreign Application Priority Data

Aug. 30, 2002 (JP) ..... 2002-254201
Dec. 26, 2002 (JP) ..... 2002-377241

(51) Int. Cl.
*C08G 63/08* (2006.01)

(52) U.S. Cl. ..... 525/450; 428/357; 428/364; 428/365; 428/369

(58) Field of Classification Search ..... 525/450; 428/357, 364, 365, 369
See application file for complete search history.

(56) References Cited

U.S. PATENT DOCUMENTS

| | | | | |
|---|---|---|---|---|
| 5,593,778 | A | 1/1997 | Kondo et al. | 428/373 |
| 5,811,508 | A | 9/1998 | Zeitler et al. | 528/176 |
| 6,114,495 | A | 9/2000 | Koistad et al. | 528/354 |
| 6,417,294 | B1 * | 7/2002 | Obuchi et al. | 525/450 |
| 6,710,135 | B2 | 3/2004 | Tan et al. | 525/411 |
| 6,761,970 | B2 * | 7/2004 | Ochi et al. | 428/364 |
| 2002/0094444 | A1 | 7/2002 | Nakata et al. | 428/480 |
| 2003/0054718 | A1 * | 3/2003 | Ochi et al. | 442/182 |
| 2003/0079297 | A1 | 5/2003 | Yamakita | 8/115.51 |

FOREIGN PATENT DOCUMENTS

| | | | |
|---|---|---|---|
| JP | 6-299054 | A | 10/1994 |
| JP | 8-27363 | A | 1/1996 |
| JP | 8-183898 | A | 7/1996 |
| JP | 8-260268 | A | 10/1996 |
| JP | 9-21018 | A | 1/1997 |
| JP | 9-278991 | A | 10/1997 |

(Continued)

OTHER PUBLICATIONS

Human English translation of JP 2001-131827 (Mar. 2009).

*Primary Examiner* — Randy Gulakowski
*Assistant Examiner* — Alicia Toscano
(74) *Attorney, Agent, or Firm* — Kubovcik & Kubovcik

(57) ABSTRACT

Polylactic acid fibers excellent in wearing resistance and in the ability to smoothly pass through processing steps. The polylactic acid fibers contain a fatty acid bisamide and/or an alkyl-substituted fatty acid monoamide in an amount of 0.1 to 5 wt. % based on the whole fibers.

28 Claims, 7 Drawing Sheets

FOREIGN PATENT DOCUMENTS

| | | | | |
|---|---|---|---|---|
| JP | 11-131323 | A | | 5/1999 |
| JP | 11-293517 | A | | 10/1999 |
| JP | 2000-220044 | A | | 8/2000 |
| JP | 2000-290845 | A | | 10/2000 |
| JP | 2001-131827 | A | | 5/2001 |
| JP | 2001131827 | A | * | 5/2001 |
| JP | 2001-271224 | A | | 10/2001 |
| JP | 2002-129442 | A | | 5/2002 |
| JP | 2002-155437 | A | | 5/2002 |
| JP | 2002-180328 | A | | 6/2002 |
| JP | 2002-285438 | A | | 10/2002 |
| JP | 2002-285439 | A | | 10/2002 |
| JP | 2003-129334 | A | | 5/2003 |
| WO | 99-63001 | A1 | | 12/1999 |
| WO | 02-12395 | A1 | | 2/2002 |

* cited by examiner

POLYLACTIC ACID FIBER YARN PACKAGE, AND TEXTILE PRODUCTS

This application is a continuation of application Ser. No. 10/525,092, filed Feb. 23, 2005, now abandoned which is a 371 of international application PCT/JP2003/011135, filed Sep. 1, 2003, which claims priority based on Japanese Patent Application Nos. 2002-254201 and 2002-377241, filed Aug. 30, 2002, and Dec. 26, 2002, respectively, and which are incorporated herein by reference.

FIELD OF THE INVENTION

The present invention concerns polylactic acid fibers that make of biodegradable polylactic acid.

BACKGROUND ART

Recently, as people become more concerned about environmental problems, global warming and the depletion of oil resources have become major issues.

With that as background, there is a need for naturally recycling environmentally friendly materials composed of biomass, which decompose into water and carbon dioxide after use. Polylactic acid has attracted the most attention among biodegradable polymers using biomass. Polylactic acid is a kind of aliphatic polyester using, as raw material, lactic acid obtained from the fermentation of starch extracted from plants and it presents the best balance of dynamical characteristics, heat resistance and cost efficiency of biodegradable polymers using biomass. Therefore, resin products, fibers, films, sheets and other such materials utilizing it are being rapidly developed.

The application development of polylactic acid fibers has already commenced with agricultural materials, civil engineering materials and so on, which profit from biodegradability; however its application in apparel, curtains, carpets and other interior goods, or car interior goods, and other such industrial materials is also expected to be large application fields.

Howsoever, the polylactic acid fibers did have inconveniences such as a high surface friction coefficient and low wearing resistance. For instance, wearing resistance in accordance to JIS L 0849 is generally required to be of grade 3 or better, but that of conventional polylactic acid fibers was as low as grade 1.

Consequently, the development of applications requiring wearing resistance such as apparel, interior goods, car interiors and the like has not progressed very far. For instance, if conventional polylactic acid fiber are used in applications such as outerwear, uniforms, sport wear, the quality degrades through fluffing, whitening, shine and so on in the shoulders, elbows, knees, hips or the like which are often submitted to wearing in daily life, or color migration to innerwear and other such problems. In addition, also in the application to upholstery, carpets and so on, durability was low, causing fluffing, wear and tear of fibers through repeated wearing and color migration to clothing that includes trousers, socks and so on, and other such problems have been encountered.

The high surface friction coefficient of polylactic acid fibers has also caused problems in the yarn-making, yarn treatment, cloth cutting and sawing processes.

In the melting and spinning process, fluffing or yarn being easily cut occur because of large friction quotient between the yarn and the guide or the like, when the yarn travels at the high speeds of 1000 to 7000 m/min. And on the other hand, the yarn twines around the roller and easily breaks, in the drawing process. Yarn break and fluffing often occur due to friction between the yarns and the twisted body, or between yarns, during the yarn treatment process, particularly the temporary standing process, largely decreasing ability to smoothly pass through processing steps and the quality of the product.

In general, in the industrial fabric cutting process a plurality of clothing items are superposed and then cut and here in the case of cloth using conventional polylactic acid fibers, they tend to fuse with each other because of the large shearing heat generated between the cutter and the fiber.

In the sawing process, at normal sawing speed, fibers fuse thus deteriorating the quality of the product, through the generation of friction heat between the machine needles and the fibers, or polymer deposits on the machine needles cause the necessity for frequent replacement of machine needles, therefore, lowering processing speed, and subsequently the productivity.

It is considered that the high friction coefficient of polylactic acid fibers causing these problems depends on the polymer matrix, and that these problems are inevitable with polylactic acid fibers.

Incidentally, in the field of resin products, films, sheets and the like, smoothing agent is sometimes added to the polymer in the manufacturing process, in order to improve the anti-blocking characteristic of chips or fused polymers or to facilitate the release of the mold from the die or roller. However, in the field of fibers, the addition of smoothing agent has been avoided, because fiber macula, dying macula or other product quality deteriorations easily occur from blending unevenness, heat decomposition, bleed out or the like of the smoothing agent.

Examples of smoothing agent addition to fiber are extremely few; however, for example, Japanese Patent Laid-Open Publication No. 1996-183898 discloses one. The technology concerned consists of adding a fatty monoamide, expressed by the general formula $RCONH_2$ (here, R represents an alkyl group), to polylactic acid fibers and has the objective of suppressing hydrolysis speed by imparting water repellency. However, there is no description concerning the improvement of wearing resistance and ability to smoothly pass through processing steps of polylactic acid fibers, which is the objective of the present invention. To be sure, the Inventors did double-check polylactic acid fibers in which a fatty monoamide had been added, however, wearing resistance and ability to smoothly pass through processing steps of polylactic acid fibers could not be improved upon (Cf. Comparative examples 4, 5). The Inventors inferred that the cause thereof is the fact that the fatty monoamide reacts with polylactic acid during fusion, because the amide group thereof is highly reactive and as a result, the proportion of fatty monoamide that can function as smoothing agent in fibers of fatty monoamide decreases.

In some cases, when a fatty monoamide reacts with polylactic acid, molecular chains of polylactic acid end up cut and consequently molecular weight decreases, lowering the fiber properties.

Moreover, fatty monoamides, having high sublimation property or low heat resistance, sometimes cause deterioration of the work environment through smoke, fouling of guides, rollers or the like through bleeding out, and deterioration of operating efficiency. Furthermore, bled out fatty monoamide condenses on the fiber surface, sometimes causing fiber property macula or dying macula.

Consequently, the present invention has the objective of providing polylactic acid fibers that excellent wearing resistance and ability to smoothly pass through processing steps.

DISCLOSURE OF THE INVENTION

The present invention is made of the following composition:

(1) Polylactic acid fibers comprising 0.1 to 5 weight % of fatty acid bisamide and/or alkyl-substituted fatty acid monoamide of their total fiber;

(2) The polylactic acid fibers of the aforementioned (1) where the b* value in the fiber L*a*b* color specification system is −1 to 5;

(3) The polylactic acid fibers of the aforementioned (1) or (2) where the melting point of fatty acid bisamide and alkyl-substituted fatty acid monoamide are 80° C. or higher;

(4) The polylactic acid fibers of any one of the aforementioned (1) to (3) where the carboxyl end group amount of polylactic acid composing the fiber is 40 eq/t or less;

(5) The polylactic acid fibers of any one of the aforementioned (1) to (4) where the weight-average molecular weight of polylactic acid composing the fiber is 50,000 to 500,000;

(6) The polylactic acid fibers of any one of the aforementioned (1) to (5) where the strength is 2.0 cN/dtex or more;

(7) The polylactic acid fibers of any one of the aforementioned (1) to (6) where the elongation is 15 to 70%;

(8) The polylactic acid fibers of any one of the aforementioned (1) to (7) where the boiling-water shrinkage rate is 0 to 20%;

(9) The polylactic acid fibers of any one of the aforementioned (1) to (8) where components composing the fiber has its exothermic peak of crystallization in a temperature decrease at 100° C. or higher;

(10) The polylactic acid fibers of any one of the aforementioned (1) to (9) having the form of filament;

(11) The polylactic acid fibers of the aforementioned (10) where the thickness unevenness U % of a yarn made of said filament 1.5% or less;

(12) The polylactic acid fibers of the aforementioned (10) or (11) not having crimp by crimping process and having, on the fiber surface, at least one kind of smoothing agent selected from fatty acid ester, polyalcohol ester, ether ester, silicone and mineral oil;

(13) The polylactic acid fibers of the aforementioned (10) or (11) having crimp by fluid texturing process;

(14) The polylactic acid fibers of the aforementioned (13) having, on the fiber surface, at least one kind of smoothing agent selected from fatty acid ester, polyalcohol ester, ether ester, silicone and mineral oil;

(15) The polylactic acid fibers of the aforementioned (13) or (14) having the following characteristics:

Crimping elongation 3 to 35%

Single fiber fineness 3 to 35 dtex

Degree of modified cross section 1.1 to 8

(16) The polylactic acid fibers of the aforementioned (10) or (11) having crimp by false-twist texturing;

(17) The polylactic acid fibers of the aforementioned (16) having, on the fiber surface, a smoothing agent having polyether as principal component;

(18) The polylactic acid fibers of the aforementioned (17) wherein the polyether is an addition compound copolymerized with alkylene oxide whose number of carbon is 2 to 4 to an alcohol having one or more hydroxyl group(s) in the molecular or a derivative thereof;

(19) The polylactic acid fibers of the aforementioned (16) to (18) having the following characteristics:

90° C. strength≧0.4 cN/dtex

CR≧10%

Non-untwisted number≦3/10 m

(20) The polylactic acid fibers of the aforementioned (19) where boiling-water shrinkage rate is 15% or less;

(21) The polylactic acid fibers of the aforementioned (1) to (9) having the form of staple fiber;

(22) The polylactic acid fibers of the aforementioned (21) having, on the fiber surface, at least one kind of smoothing agent selected from fatty acid ester, polyalcohol ester, ether ester, silicone and mineral oil;

(23) The polylactic acid fibers of the aforementioned (21) or (22) having the following characteristics:

Crimp number≧6/25 mm

Crimp ratio≧10%

(24) A yarn package made by winding the filament of the aforementioned (10);

(25) The yarn package of the aforementioned (24) wherein the saddle of package is 7 mm or less;

(26) A textile product where the polylactic acid fibers of the aforementioned (1) to (23) is used at least in a part;

(27) The textile product of the aforementioned (26) which is knitting;

(28) The textile product of the aforementioned (26) which is a textile;

(29) The textile product of the aforementioned (26) wherein the textile product is a nonwoven fabric;

(30) The textile product of the aforementioned (26) which is a carpet; and

(31) The textile product of any one of the aforementioned (26) to (30) wherein the dry friction solidity degree is grade 3 or more, and the wet friction solidity degree is grade 2 or more.

BEST MODE FOR CARRYING OUT THE INVENTION

Figure 1:
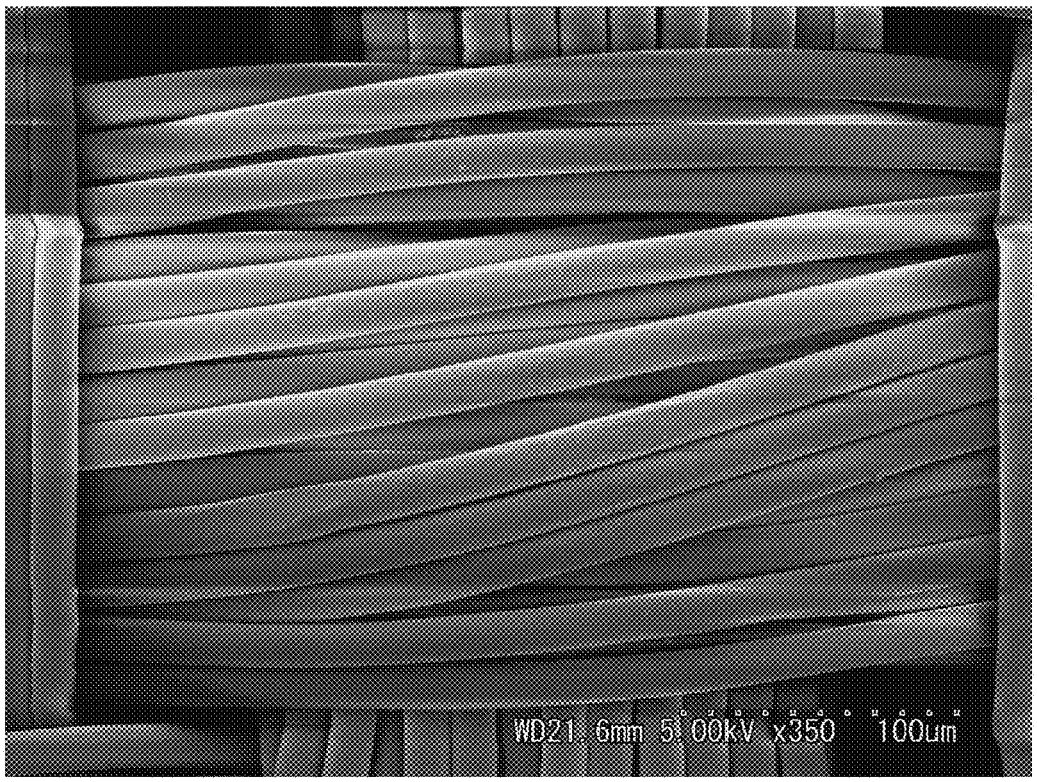
FIG. 1 shows the surface state of the polylactic acid fibers of the present invention after the test of solidity to friction.

The fiber of the present invention is polylactic acid fibers composed essentially of polylactic acid.

Polylactic acid fibers mean, in the present invention, the one obtained by polymerization of oligomer of polylactic acid such as polylactic acid, lactide, and so on, having —(O—$CHCH_3$—CO)n— as repeated unit.

The polylactic acid has two optical isomers, D body and L body. As for both L body and D body, the higher the optical purity is, the higher the melting point is. Therefore, the high purity is preferable because the heat resistance increases. Concretely, the optical purity is preferably 90% or more.

Separately from the system wherein two kinds of optical isomers are simply mixed as mentioned above, it is preferable to blend said two kinds of optical isomers and mold into fibers and, thereafter, and heat to a high temperature of 140° C. or higher and obtain a stereo complex where racemic crystals are formed, because this allows rising the melting point dramatically.

Also, in the case of using the polylactic acid fibers of the present invention as binder (heat adhesive fiber), it is preferable to adopt a polylactic acid having a low optical purity and obtain polylactic acid fibers having the relatively low melting point.

For the polylactic acid fibers of the present invention, the carboxyl end group concentration of the polylactic acid composing the fiber is preferably 40 eq/t or less. By so doing, the polylactic acid fibers can be used without strength deterioration by hydrolysis even in a hot and wet environment. The carboxyl end group concentration of the polylactic acid is more preferably 30 q/t or less and still more preferably 10 eq/t or less. As for method for lowering the carboxyl end group concentration, a method for extracting beforehand low molecular weight matters such as lactide in the polylactic acid resin, a method for blocking the carboxyl end group during the fiber spinning by adding end-blocking agent, and so on can be cited.

The molecular weight of polylactic acid is preferably 50 to 500 thousands in weight-average molecular weight. By making it 50 thousands or more, practically useful dynamical characteristics can be obtained, and by making it 500 thousands or less, a satisfactory yarn-making property can be obtained.

As for manufacturing method of polylactic acid, the direct dehydrating condensation method for dehydrating condensation of polylactic acid as it is under the presence of organic solvent and catalyst, disclosed for instance in Japanese Patent Laid-Open Publication No. 1994-65360, the method for copolymerization and ester exchange reaction of at least two kinds of homopolymer under the presence of polymerization catalyst, disclosed for instance in Japanese Patent Laid-Open Publication No. 1995-173266, the indirect polymerization method for dehydrating once polylactic acid to obtain cyclic dimer before ring-opening polymerization thereof, disclosed for instance in the Specification of U.S. Pat. No. 2,703,316, and so on can be adopted.

The color tone of the raw material polylactic acid itself is preferably satisfactory, so that the color tone of the polylactic acid fibers of the present invention is satisfactory. To be more specific, b* value in the L*a*b* color specification system is preferably −5 to 5. As for the concrete method to achieve such color tone, it is preferable to use metalinactive agent, antioxidant or the like, lower the polymerization temperature and suppress the catalyst addition ratio as described, for instance, in Japan Unexamined Patent Publication No. 1995-504939.

It is also effective to reduce residual oligomer and/or monomers such as lactide in terms of prevention of heat deterioration and color tone improvement. Residual oligomer and/or monomers can be reduced largely through the depression processing of polymers, or the extraction processing with chloroform or the like. The reduction of residual oligomer and/or monomers is also desirable in terms of suppression of hydrolysis of polylactic acid and improvement of practical durability. The quality of residual oligomer and/or monomer is preferably 0 to 0.2 weight % to polylactic acid, more preferably 0.1 weight % or less, and still more preferably 0.05 weight % or less.

Moreover, components other than lactic acid may be copolymerized; polymers other than polylactic acid can be blended or used for complex fiber spinning, within a range not to deteriorate the property of polylactic acid. As for polymers other than polylactic acid, for instance, polyethylene terephthalate, polytrimethylene terephthalate, polybutylene terephthalate, nylon, polybutylene succinate, polyhydroxy butylate and so on can be cited. Among others, polybutylene succinate and polyhydroxy butylate, derived from biomass as polylactic acid, and being biodegradable are preferable as polymers other than polylactic acid. They can be blended by chip blending or fusion blending. As for the form complex fiber spinning, core-in-sheath type, side-by-side type and so on can be adopted.

However, from the view point of biomass usage and biodegradability, the content of lactic monomer to polymer is preferably 50 weight % or more, more preferably 75% weight % or more and still more preferably 96 weight % or more.

For the polylactic acid fibers of the present invention, it is important to contain fatty acid bisamide and/or alkyl-substituted fatty acid monoamide. By so doing, the surface friction coefficient of the polylactic acid fibers can be reduced. Here, "and/or" means that either fatty acid bisamide or alkyl-substituted fatty acid monoamide may be contained, or both of fatty acid bisamide and alkyl-substituted fatty acid monoamide may be contained. Hereinafter, fatty acid bisamide and alkyl-substituted fatty acid monoamide shall also be called "specific fatty acid amide" collectively.

As mentioned above, fatty acid monoamide that has been known as smoothing agent for polylactic acid fibers has lost its function as smoothing agent in the polylactic acid fibers; however, the "specific fatty acid amides" adopted for the present invention have a lower reactivity than the usual fatty acid monoamide, are hard to react with polylactic acid during the fusion forming and, namely, can preserve their function as smoothing agent. Also, as many of them have a high molecular weight, they generally have a good heat resistance and are hard to sublime. Especially, fatty acid bisamide has a further lower reactivity with polylactic acid and can further suppress the bleed out in the fused polymer as they have a large molecular weight. By suppressing the bleed out, property unevenness or dyeing unevenness can be suppressed The fatty acid bisamide of the present invention means an fatty acid amid having two amid bonds in a single molecular and, for example, methylene-bis amide caprylate, methylene-bis amide caprate, methylene-bis amide laurate, methylene-bis amide myristate, methylene-bis amide palmitate, methylene-bis amide stearate, methylene-bis amide isostearate, methylene-bis amide behenate, methylene-bis amide oleate, methylene-bis amide erucinate, ethylene-bis amide caprylate, ethylene-bis amide caprate, ethylene-bis amide laurate, ethylene-bis amide myristate, ethylene-bis amide palmitate, ethylene-bis amide stearate, ethylene-bis amide isostearate, ethylene-bis amide behenate, ethylene-bis amide oleate, ethylene-bis amide erucinate butylene-bis amide stearate, butylene-bis amide behenate, butylene-bis amide oleate, butylene-bis amide erucinate, hexamethylene-bis amide stearate, hexamethylene-bis amide behenate, hexamethylene-bis amide oleate, hexamethylene-bis amide erucinate, m-xylylene-bis amide stearate, m-xylylene-bis-12-amide hydroxystearate, p-xylylene-bis amide stearate, p-phenylene-bis amide stearate, p-phenylene-bis amide stearate, N,N'-distearyl amide adipate, N,N'-distearyl amide sebacate, N,N'-dioleyl amide adipate, N,N'-dioleyl amide sebacate, N,N'-distearyl amide isophthalate, N,N'-distearyl amide terephthalate, methylene-bis amide hydroxystearate, ethylene-bis amide hydroxystearate, butylene-bis amide hydroxystearate, hexamethylene-bis amide hydroxystearate, and so on may be cited.

Besides, the alkyl-substituted fatty acid monoamide of the present invention means compounds where amide hydrogen of fatty acid monoamide is substituted with an alkyl group and, for example, N-lauryl amide laurate, N-palmityl amide palmitate, N-stearyl amid stearate, N-behenyl amide behenate, N-oleyl amid oleate, N-stearyl amid oleate, N-oleyl amid stearate, N-stearyl amid eruciate, N-oleyl amid palminate, and so on can be cited. The alkyl group may have a substitutent such as hydroxyl group introduced in its structure and, for example, methylol amide stearate, methylol amid behenate, N-stearyl-12-hydroxy amide stearate, N-oleyl 12 hydroxy amide stearate, and so on are also included in the alkyl-substituted fatty acid monoamide of the present invention.

For the "specific fatty acid amide", it is preferable that the melting point is 80° C. or higher. Here, the "melting point" means the crystal fusion peak temperature when the temperature is raised by 16° C./min in DSC (differential scanning calorimetry). By raising the melting point to 80° C. or more, the "specific fatty acid amide" of the present invention is prevented from sublimation, even if it is exposed to a hot environment such as intermediate set, dyeing and so on, after obtaining textile products according to the present invention. The melting point is preferably 100° C. or higher, and more preferably 140° C. or higher. Considering the compatibility with polylactic acid and formability, the melting point is preferably 200° C. or lower.

It is important that the content of "specific fatty acid amide" is 0.1 to 5 wt % of their total fiber. By making it 0.1 wt % or more, an effective of reducing the surface friction coefficient of polylactic acid fibers can be proved. Also, by making it 5 wt % or less, the "specific fatty acid amide" can be dispersed finely, and property unevenness or dyeing unevenness can be prevented from occurring. The content of "specific fatty acid amide" is preferably 0.5 to 3 wt %. A single kind of "specific fatty acid amide" can be used independently, or several kinds may be used. In case of using several kinds, the total of "specific fatty acid amide" may be contained by 0.1 to 5 wt % to the total fibers.

As for methods for containing "specific fatty acid amide" in the polylactic acid fibers, for example, a method for adding during the copolymerization of polylactic acid, a method for making kneaded chips by means of a kneader, a method for depositing on the polylactic acid resin chip surface, a method for adding in the melting and spinning process and so on can be cited.

As for the method of using a kneader, chips can be made by matching the addition quantity of "specific fatty acid amide" to the polylactic acid fibers with a desired content and kneading polylactic acid and the "specific fatty acid amide"; however kneaded chips (master chips) which contains the "specific fatty acid amide" of high concentration beforehand are made, thereafter, diluting kneaded chips (master chips) through blending with the polylactic acid chips so that the desired content is attained when it is input into a spinning machine is also preferable. Moreover, a method of weighing and adding the fused smoothing agent in the process of using the kneader is also preferable because the pyrolysis of smoothing agent is suppressed, and the coloration is further suppressed.

Concerning the method of adding during the melting and spinning process, the "specific fatty acid amide" can be dispersed finely in the polylactic acid by installing a stationary kneader in the spinning pack. As for the method for adding by means of the stationary kneader, for instance, polylactic acid and the "specific fatty acid amide" can once be kneaded by a kneader and then kneaded furthermore and dispersed finely by the stationary kneader in the spinning pack or, otherwise, the polylactic acid and the "specific fatty acid amide" can be melted separately, respective melted liquids may be led into the spinning machine, kneaded and dispersed finely by the stationary kneader in the spinning pack.

The addition quantity (feed quantity) of the "specific fatty acid amide" to fibers may be 0.1 to 5 wt % in correspondence to the aforementioned content. It is set to 0.1 wt % or more for the same reason as above mentioned. Besides, by setting it 5 wt % or less, excessive fatty acid amide is prevented from bleeding out from the melted polymer during the kneading or spinning. The prevention of bleed out permits to prevent the fatty acid amide from subliming or decomposing, and causing smoke and deteriorating the work environment, or soiling the extrusion kneader or the melting and spinning machine and lowering the working efficiency. In addition, the prevention of bleed out permits to stabilize the discharge of polymer from the spinning spinneret, and to suppress the yarn unevenness. Furthermore, by suppressing to 5 wt % or less, agglutination of fatty acid amide in the melded polymer can be suppressed, heat deterioration of fatty acid amide or reaction with polylactic acid can be suppressed, and a tincture of yellow can be suppressed. The addition quantity (feed quantity) of the "specific fatty acid amide" is preferably 0.5 to 3 wt %.

Components of the polylactic acid fibers according to the present invention may contain polymers other than polylactic acid, particles, fire retardant, antistatic agent, delusterant, deodorant, antibacterial agent, antioxidant, coloring pigment or other additives.

As for the embodiment of melting and spinning of polylactic acid fibers of the present invention, melted polymer is weighed to a predetermined quantity by means of a weighing pump and, thereafter, led into a spinning pack installed in a heated spin block. At that time, the spinning temperature is preferably 180 to 240° C. depending on the co-polymerization rate or molecular weight of the polylactic acid to be used. By setting it to 180° C. or more, the melt extrusion is made easier, and by setting it to 240° C. or lower, the coloring of "specific fatty acid amide" by heat decomposition can be suppressed. The spinning temperature is more preferably 185 to 230° C. and still more preferably 190 to 220° C. The melted polymer is filtered in the spinning pack for eliminating foreign matters and spun out from the spinneret. The residence time of the polymer from melting to spinning out is preferably short, because the shorter it is, the further the coloration of fibers is suppressed. The residence time is preferable within 30 min, more preferably within 20 min, still more preferably within 15 min, and furthermore preferably within 10 min.

In case where the work environment may be worsened by sublimation or evaporation of low molecular weight material such as lactide or added smoothing agent according to the heat decomposition of polylactic acid, it is preferable to install a suction system under the spinneret.

As for the cross sectional shape of the polylactic acid fibers of the present invention, in the case of so-called flat yarn, without crimp by crimping process, circular section, hollow section, trifoil section or other multifoil section and also other different cross-sections can be selected freely.

In the case of polylactic acid fibers having crimp by the fluid texturing process, their cross-sectional shape may well be circular, however, it is preferable to adopt modified cross sections such as multifoil shape, cross shape, curb shape, W shape, S shape or X shape. Among them, multifoil shapes of 3 to 8 lobes are particularly preferable from the viewpoint of wearing resistance. It is also preferable to adopt hollow fibers having at least one hollow part in the fiber cross-section.

Figure 3:
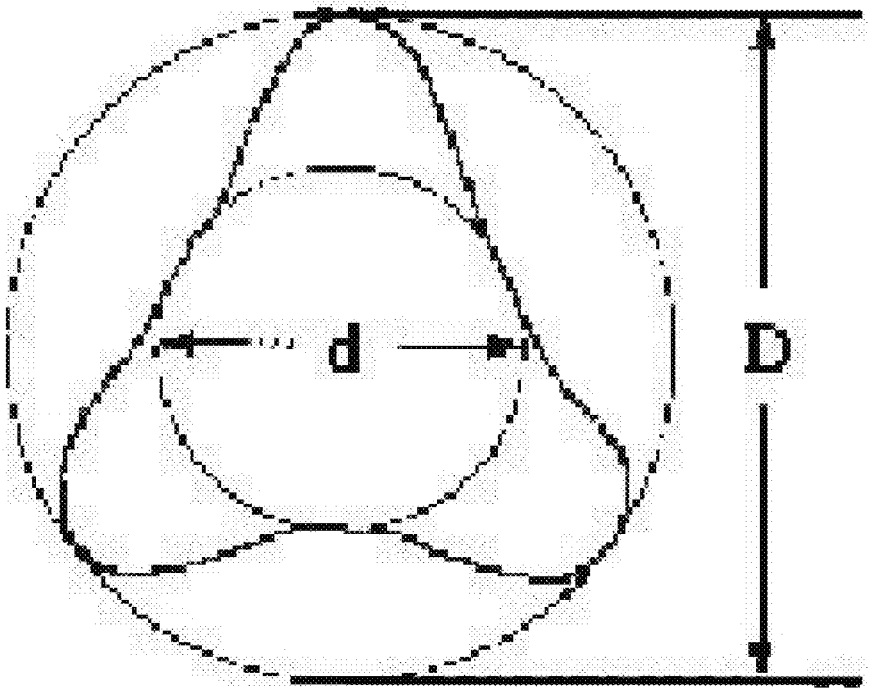
FIG. 3 illustrates the degree of modification of the fiber cross-section of the polylactic acid fibers of the present invention.

Besides, in the case of polylactic acid fibers having crimp by the fluid texturing process, the degree of modification of the section is preferable 1.1 to 8. The degree of modification of the fiber cross-section can be obtained by the following formula from the diameter D of the circumscribing circle and the diameter d of the inscribing circle of the fiber cross-section, as shown in FIG. 3.

$$\text{Degree of modification}=D/d$$

By making it 1.1 or more, a good gloss, softness and a high bulkiness can be added to the polylactic acid fibers having crimp by the fluid texturing process. By setting to 8 or less, wearing and fibrillating can be controlled, and the ability to smoothly pass through processing steps can be improved. More preferably, the degree of modification of the fiber cross-section is 1.5 to 6.

In the case where the polylactic acid fibers have the form of staple fiber, as for the cross section shape, circular section, hollow section, trifoil section or other multifoil section and also other modified cross sections can be selected freely. Especially, the hollow section is preferable for an application where lightness, softness and warmth retaining property are important, such as cotton pad. The hollow ratio thereof is preferably 15 to 45%. Lightness, softness and warmth retaining property are added by setting the hollow rate to 15% or higher. On the other hand, by setting the hollow ratio to 45% or less, a high stiffness can be kept, and crush of the hollow part is suppressed during the manufacturing process of textile products. Here, the hollow ratio can be determined by the following formula from the area of the fiber cross-section including the hollow part A and the area of the hollow part a.

$$\text{Hollow ratio (\%)}=[a/A]\times 100$$

The spun out polymer is cooled and solidified through a cooling device, for instance, with cooling wind, to become fiber, and the group of polylactic acid fibers is converged by an oil feel device, and added with spinning smoothing agent at the same time.

The polylactic acid fibers of the present invention are preferably added with a spinning smoothing agent containing a smoothing agent, namely, it is preferable that they have smoothing agent on the fiber surface. Components of the smoothing agent are preferably selected conveniently according to the application.

For instance, in the case of polylactic acid fibers without crimp by crimping process, so-called flat yarn, in the case of polylactic acid fibers having crimp by the fluid texturing process, or in the case of staple fiber, it is preferable to have, on the fiber surface, at least one kind of smoothing agent selected from aliphatic ester, polyalcohol ester, ether ester, silicone and mineral oil (hereinafter, called also as "smoothing agent for non-false-twist texturing"). By so doing, yarn break or fluffing in the spinning or drawing process, wrapping around the roller can be suppressed. In the case of staple fiber, the ability to smoothly pass through processing steps of fiber spinning, drawing, card and spinning, and the quality of the obtained staple fiber itself can be improved.

Among the aforementioned smoothing agents, aliphatic ester and mineral oil are particularly preferable for the aforementioned application. As for aliphatic ester, for instance, methyl oleate, isopropyl myristate, octyl palmitate, oleyl laurate, oleyl oleate, isotridecyl stearate and other esters of monohydric alcohol and monocarbonic acid, dioctyl sebacate, dioleyl adipate and other esters of monohydric alcohol and polycarbonic acid, ethylene glycol dioleate, trimethyl propane tricaprylate glyceric trioleate, and esters of polyhydric alcohol and monocarbonic acid, laury $(EO)_n$ octanoate and other alkylene oxide added esters may be cited. Besides, the aforementioned smoothing agents may be used as a single component, or a plurality of components may be blended and used.

Moreover, for instance, in case where polylactic acid fibers have crimps by the false-twist texturing, it is preferable to have a smoothing agent including polyether as main component (hereinafter, called also as "smoothing agent for false-twist texturing") on the fiber surface. Addition of a smoothing agent including polyether as main component to the polylactic acid fibers allows to increase the friction coefficient between fiber and metal, namely, to take a higher friction coefficient between fibers and the twisted body and to add crimps stably by the false-twist texturing. On the other hand, as the friction coefficient between fibers can be lowered, the ability to migrate on the false-twisting heater improved and, at the same time non-untwining can be suppressed, and the quality of textile products can be improved.

As for polyether, compounds obtained by copolymerization of alcohol having one or more hydroxyl groups in the molecule and alkylene oxide of the carbon number 2 to 4, and compounds derived from them may be cited.

Concerning alcohols, any natural or synthesized monohydric alcohol monoalcohol of the carbon number 1 to 30 (methanol, ethanol, isopropanol, butanol, isoamyl alcohol, 2-ethyl hexanol, lauryl alcohol, isotridecyl alcohol, isocetyl alcohol, stearyl alcohol, isostearyl alcohol, and so on), dihydric alcohol (ethylene glycol, propylene glycol, neopentyl glycol, hexylene glycol, and so on) and trihydric alcohol or higher polyhydric alcohol (glycerin, trimethylol propane, pentaerythritol, sorbitan, sorbitol and so on) may be cited.

As alkylene oxide of the carbon number 2 to 4, ethylene oxide (hereinafter, abbreviated as "EO"), 1,2-propyrene oxide (hereinafter, abbreviated as "PO"), 1,2-butylene oxide (hereinafter, abbreviated as "BO"), tetrahydrofuran (hereinafter, abbreviated as "THF") and so on may be cited.

In the case of co-polymerization of EO and the other alkylene oxides, it is preferable to set the rate of EO to 5 to 80 wt % in terms of the viscosity in case where the smoothing agent is aqueous solution or aqueous emulsion or the balance of heat resistance on the heater of the drawing friction false-twist texturing process and so on. Besides, the method for addition may be any of random addition or block addition.

As for compounds derived from co-polymerized addition compounds of alkylene oxides, compounds where hydroxyl end group is alkoxyled with an alkyl group of the carbon number 1 to 12 and/or achyled, compounds where it esterized with dicarbonic acid of the carbon number 2 to 12, or compounds where it urethanated with aliphatic or aromatic diisocyanate compounds and so on can be cited.

The weight-average molecular weight of the polyether type smoothing agent is preferably 500 to 30000, more preferably 800 to 20000 and still more preferably 1200 to 15000, considering the viscosity of the case where the smoothing agent is aqueous solution or aqueous emulsion or the balance of heat resistance on the heater of the drawing friction false-twist texturing process and so on.

As concrete example of the polyether type smoothing agent, for example, butanol (EO/PO) random adduct (EO/PO weight ratio: 50/50, weight-average molecular weight: 1400), hexylene glycol (EO/PO) random adduct (EO/PO weight ratio: 40/60, weight-average molecular weight: 4000), methyl ether of trimethylol propane (PO)(EO) block adduct (EO/PO weight ratio: 20/80, weight-average molecular weight: 5000), and so on can be cited.

Smoothing agent may be blended with any component to a degree not to damage its property. Smoothing agent blended with any component is also called "oil agent". As for arbitrary component, emulsifier for emulsifying oil agent in the water to lower the viscosity, and for improving adhesion on and penetration into fibers, antistatic agent, ionic surface active agent, binder, rust preventing agent, antiseptic agent, antioxidant, and so on may be adopted.

The content of smoothing agent for non-false-twist texturing to the purity content of oil agent is preferably 30 to 95 wt %. By making it 30 wt % or more, the fiber surface friction coefficient decreases largely to improve, allowing to improve the ability to smoothly pass through processing steps and the quality of fibers and textile products. Besides, by making it 95 wt % or less, oil the dispensability of oil agent into the water can be improved and the adhesion evenness of lubricant on fibers can be suppressed, The content is more preferably 55 to 75 wt %.

On the other hand, the content of smoothing agent for false-twist texturing to the purity content of oil agent is preferably 40 wt % or more. By so doing, heater soiling, guide soiling or twisted body surface soiling can be suppressed to extend the cleaning cycle or the replacement cycle of the drawing friction false-twist texturing device. Moreover, fluffing during the passage through processing steps can be suppressed by reducing the friction between fibers, or the quality of false-twist textured yarn can be improved by enhancing the migration. The content is more preferably 60 wt % or more, and still more preferably 80 wt % or more.

The oil agent contains preferably smoothing agent for non-false-twist texturing or smoothing agent for false-twist texturing, is made as aqueous solution or aqueous emulsion. The concentration of oil agent to the aqueous solution or aqueous emulsion is preferably 0.5 to 20 wt % and more preferably 5 to 18 wt % from the point of adhesion efficiency to fibers, fluidity or viscosity, coating formation property of aqueous solution or aqueous emulsion.

The oil agent can be added to aqueous solution or aqueous emulsion by weighing lubrication by means of nozzle, roller lubrication, or methods combining them can be adopted. In the case of oiling at the spinning in a high speed, the weighing feed using especially a nozzle can be adopted preferably.

The quantity of the adding the purity content of oil agent for the total polylactic acid fibers is preferably 0.1 to 3.0 wt %, in any of the case of using smoothing agent for non-false-twist texturing and the case using smoothing agent for false-twist texturing. By making it 0.1 wt % or more, converging, smoothing or other properties as smoothing agent can be exerted sufficiently. On the other hand, by setting it 3.0 wt % or less, soiling of the device by the spill of the oil agent during the process and thereof deterioration of the ability to smoothly pass through processing steps can be prevented, and the stable production can be obtained. Moreover, in the false-twist texturing, the migration can by improved by lowering between fibers sufficiently, and the twisting capability can be improved by increasing the friction between fiber and metal, and the yarn break on the heater can be prevented. The adhesion quantity is more preferably 0.2 to 2.0 wt %, and still more preferably 0.2 to 1.5 wt %.

Figure 4:
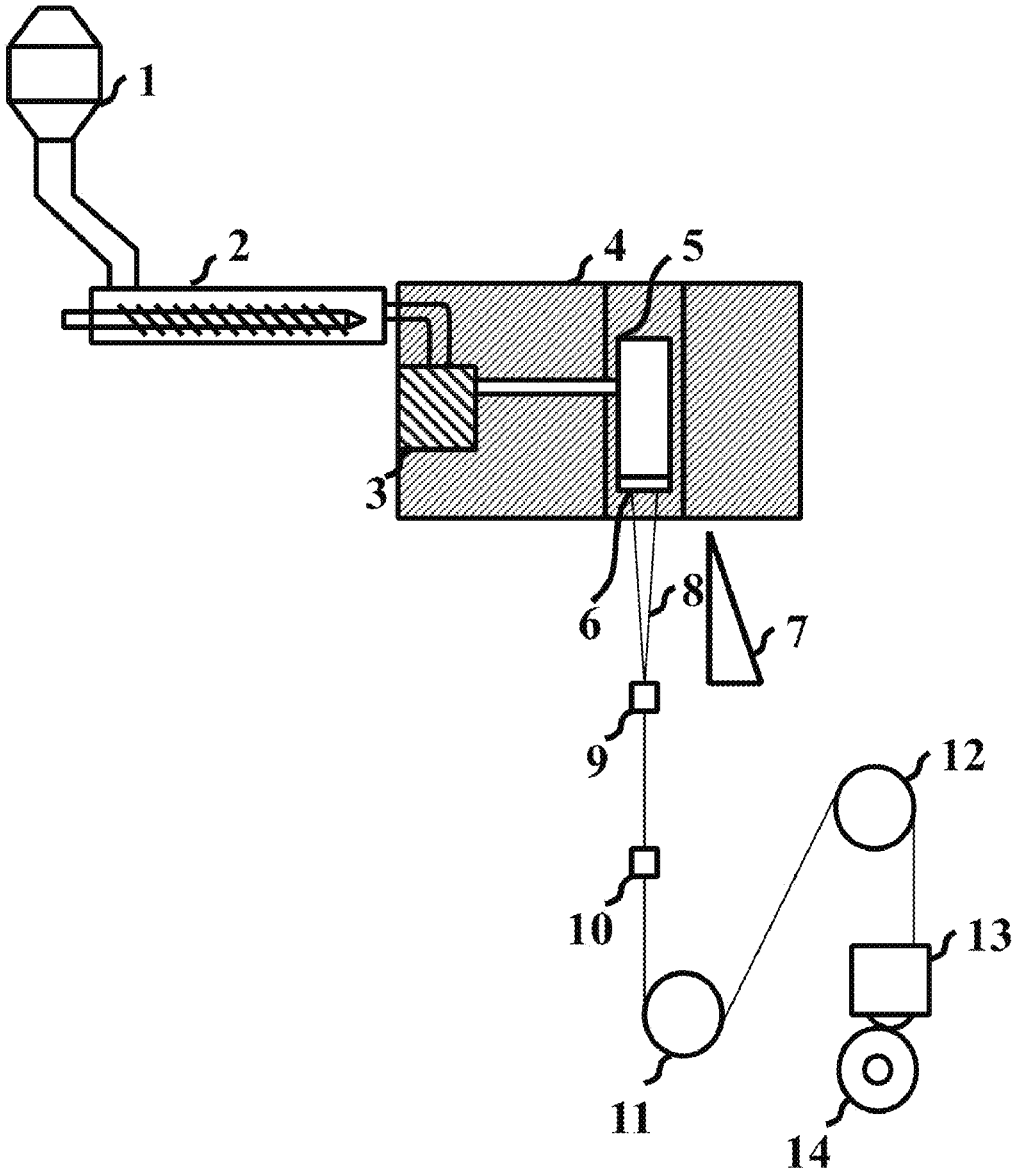
FIG. 4 is a schematic view of a spinning device used preferably for manufacturing the polylactic acid fibers of the present invention.
Figure 6:
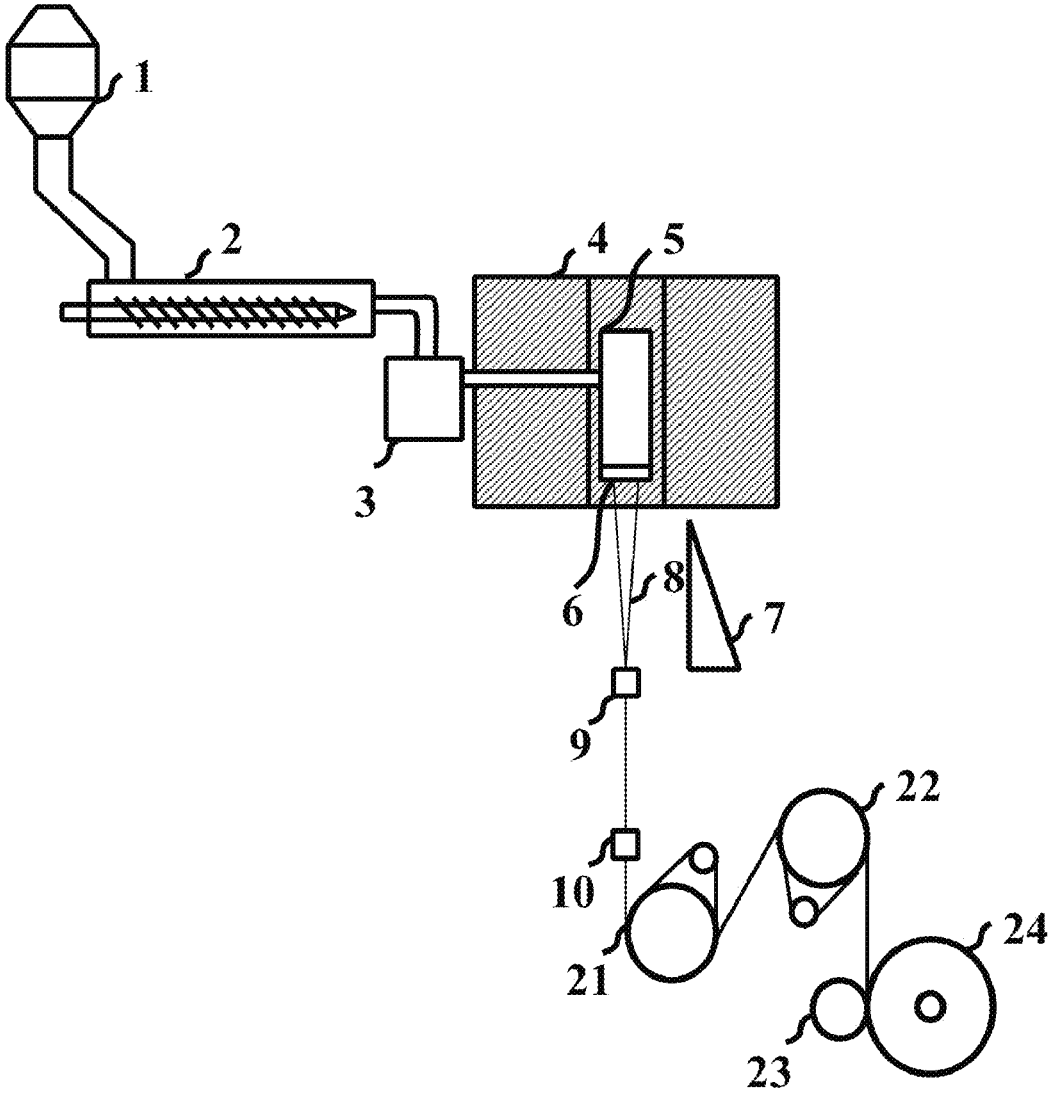
FIG. 6 is a schematic view of direct spinning and drawing device used preferably for manufacturing the polylactic acid fibers of the present invention.

Polylactic acid fibers converged and fed by oil feed device, in case where they are to be taken up as filament, are taken up for instance by a spinning device shown in FIG. 4 or by the direct spinning and drawing device shown in FIG. 6. In the case of spinning device shown in FIG. 4, they are taken up by a winding device through the first take-up roller 11, the second take-up roller 12, which are unheated.

Here, the circumferential speed (hereinafter, called also as "spinning speed") of the first take-up roller 11 is preferably 2500 to 7000 m/min. By setting the spinning speed within this range, polylactic acid fibers having excellent uniformity can be obtained. The spinning speed is more preferably 4000 to 7000 m/min. By setting it within this range, polylactic acid fibers are oriented and crystallized to develop the fiber inner structure. Therefore, the heat resistance is improved, the yarn softening on the heater is prevented, the yarn running is stabilized on the heater, and the process stability is improved. Besides, the dimensional stability and crimping properties are improved by drawing or false-twist texturing at a high temperature those polylactic acid fibers highly orientation crystallized, and their heat resistance of drawn yarn or false-twist textured yarn is also improved.

The heat resistance can be evaluated as "90° C. strength". As for polyethylene terephthalate used generally as synthetic fiber, once the fiber is orientation crystallized, its dynamic properties (tensile strength and so on) lowers if it is drawn further; however, dynamic properties of polylactic acid fibers increase, if they are drawn after their orientation crystallization. The reason why the heat resistance as expressed by 90° C. strength increases through the drawing of fibers after their oriented crystallization is not obvious; however, it is considered that, when it is heated and a stress is applied in the fiber axial direction, molecular chains are drawn from the crystal and re-crystallize, as the interaction between molecules of polylactic acid is weak, amorphous layers binding between crystals play the role of tie molecular having a high binding property and suppress the elongation deformation under the high temperature.

From this viewpoint, the spinning speed is more preferably 4250 m/min to 7000 m/min and still more preferably 4500 m/min to 6500 m/min.

Besides, from the viewpoint of preventing the yarn fluctuation on the roller surface and performing a stable production, the velocity (V1) of the first take-up roller and the velocity (V2) of the second take-up roller are preferably $0.99 \leqq V2/V1 \leqq 1.05$.

In order to prevent the reverse winding, it is preferable that the winding tension between the final godet roll and the winder should be 0.04 cN/dtex and more, and in order to release the internal structure strain of the fiber, it is preferable that it should be 0.15 cN/dtex or less.

By releasing the internal structure strain of the fiber, the saddle and bulge, to be mentioned later, can be canceled.

More preferable winding tension is 0.05 to 0.12 cN/dtex, and furthermore preferably is 0.06 to 0.1 cN/dtex.

In addition, it is preferable that the load against the line length on which the roller bail or drive roll is in contact with the package (which corresponds to a pressure against the package. Hereinafter, it will be called bearing stress) should be within the range of 6-16 kg/m. By making the bearing stress 6 kg/m or more, the package has a suitable hardness to prevent the package collapse and to suppress the saddle.

Further, by making the bearing stress 16 kg/m or less, the package destruction and bulge can be suppressed. More preferable range should be 8 to 12 kg/m. Furthermore, by making the twill angle within the range of 5 to 10°, while the yarn breakage at the edge surface of the package is suppressed, a stable unreeling tension can be obtained even in a high speed unreeling, and at the same time, yarn breakage to the edge surface part can be suppressed.

More preferably, it is, 5.5 to 8°, and furthermore preferable is 5.8 to 7°. Moreover, it is preferable to change the twill angle to suppress the ribbon. As a means, it is preferable to fluctuate the twill angle within a certain range (the center value should be within −1.5 to +1.5°) and to make the winding ratio (the ratio between the spindle rotational speed and the traverse period) constant.

Further, methods to suddenly change the twill angle in the ribbon-generation-band region is preferably used, the combination of these methods may be used. Furthermore in general, fatty acid polyester has a low bending stiffness, and acts strongly as an elastic body, therefore, it is preferable that it should be worked out to make the yarn-thread to follow at the turning-up when traversing. For example, a blade traverse method of from one axis through three axes, having a high fast-followability in a high speed, a micro-cam traverse, having excellent yarn grip ability, and a spindle traverse, which is capable of minimizing a free-length, are preferably used. In order to utilize each characteristic, it is preferable to employ the micro-cam traverse when windup speed is 2,000 to 4,000 meter/minute and the blade traverse method of from one axis through three axes when the windup speed exceeding 4,000 meter/minute.

With regard to the driving method at winding, a driving method by a drive roller is popular, however, a spindle driving method and a method in which a roller bail of the winder is compulsively driven, are preferably used. When the roller bail is compulsively driven, the roller bail velocity against the package surface velocity is suppressed in such a way that it is always overfed from 0.05 to 1% and a relaxed winding is performed, so that a better package form can be obtained.

Further, at an arbitrary place from an oil feed device 9 to a first take-up roller 11, the second take-up roller 12 and a winder 13, it is possible that a multi-filament, which is composed of polylactic acid fiber, is made to have a bundling property, and an entanglement device is established in order to give interlacement for improving unreeling property of cheese.

As for fluids used for the entanglement device, an air flow and water flow and the like can be cited, however, the air flow is preferable in that it can give a sufficient convergence and unreeling properties to the yarn, which runs at a high speed.

Figure 5:
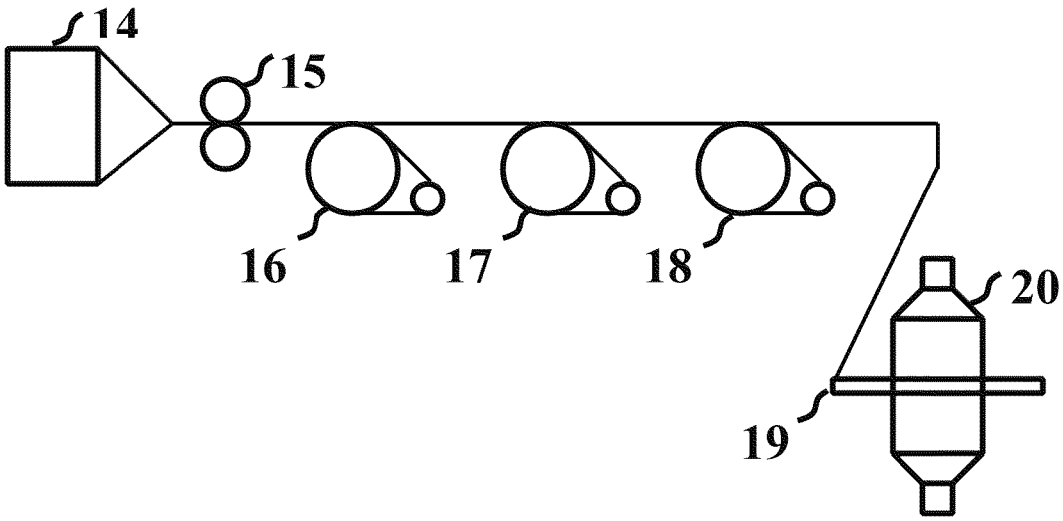
FIG. 5 is a schematic view of a drawing device used preferably for manufacturing the polylactic acid fibers of the present invention.

Moreover, when drawing a filament, for example, by the drawing device shown in FIG. 5 and the direct spinning and drawing device shown in FIG. 6, if the drawing temperature (the surface temperature of the first hot roller 16 in FIG. 4, and that of the first hot roller 21 in FIG. 6) is from 80 to 150° C., it is preferable that the occurrence of yarn unevenness can be suppressed. Further, if the heat-set temperature (the second hot roller 17 in FIG. 4 and the second hot roller 22 in FIG. 6) is from 120 to 160° C., it is preferable that boiling water shrinkage rate of the polylactic acid fiber is reduced and thermal dimensional stability is enhanced.

Furthermore, when a high strength is required like the uses of industrial materials, multistage drawing can be performed. Moreover, the shape of the polylactic acid fiber according to the present invention can be a filament or a staple fiber, and in the case of filament, it can be a mono-filament. With regard to the fineness of the polylactic acid fiber according to the present invention, for the use of clothing materials, it is preferable that the total fineness of multi-filament should be 20 to 500 dtex, and the single-yarn fineness should be 0.1 to 10 dtex. In general, the faulty wearing resistance of the polylactic acid fiber remarkably appears when the yarn fineness is smaller, however, the polylactic acid fiber according to the present invention has a sufficient wearing resistance even if the single-yarn fineness is small.

It is preferable that the polylactic acid fiber according to the present invention should have strength of 2.0 cN/dtex or more to keep a higher ability to smoothly pass through processing steps and a higher dynamic strength of the fiber product. Further, it is preferable that the polylactic acid fiber according to the present invention should have an elongation of 15 to 70% to enhance a higher ability to smoothly pass through processing steps to make a fiber product.

Furthermore, it is preferable that the polylactic acid fiber according to the present invention should have a boiling water shrinkage rate of 0 to 20% to keep a higher dimensional stability of the fiber and the fiber product. The boiling water shrinkage rate is more preferably 1 to 15%, and furthermore preferably 2 to 10%.

Further, when the polylactic acid fiber according to the present invention has crimps created by the false-twist texturing, it is preferable that the boiling water shrinkage rate should be 15% or less because the false-twist textured yarn and fiber products has an excellent dimensional stability. The boiling water shrinkage rate of the false-twist textured yarn above mentioned is more preferably 10% or less, and furthermore preferably 8% or less.

When performing a cheese dyeing, in order to conduct a uniform dyeing on the inner and outer cheese layer, and at the same time to prevent a package collapse due to shrinkage, it is preferable that boiling water shrinkage rate should be 0 to 5%.

When the polylactic acid fiber according to the present invention has a shape of yarn composed of a filament, it is preferable that the index of the thickness unevenness of the yarn, U % (Normal Test), should be 1.5% or less. By making the U % 1.5% or less, a dyeing unevenness can be prevented to obtain a higher-quality dyed fiber product. The U % is more preferably 1.0% or less.

In the polylactic acid fiber according to the present invention, it is preferable that a b* value of an L*a* b* color-specification system of the fiber should be −1 to 5. By specifying the b* value, which is an index of a color tone of a tincture of yellow, as 5 or less, the fiber can be widely used also in applications, in which the color tone is important, such as clothing materials, interior and interior members of a vehicle. It is more preferable that b* value should be 3 or less. Additionally, the polylactic acid fiber having a fatty-acid monoamide, which belongs to a conventional technique, sometimes has a high b* value and a strong tendency of a tincture of yellow. This is considered to be caused by that, in addition to the thermal degradation of the fatty-acid monoamide, which has a poor thermal resistance, the fatty-acid monoamide reacts with the carbonyl group of the polylactic acid polymer in the melt molding to form a diacetamide group. On the contrary, a "particular fatty-acid amide", which is adopted in the present invention, has an excellent thermal resistance, and because amide group has a low reactivity, a tincture of yellow of fiber is hard to be generated.

Further, with the polylactic acid fiber according to the present invention, the polylactic acid fiber can be crimped, according to applications, through such as false-twist texturing, fluid texturing process, press-fit processing and mechanical crimping. The multi-filament of the polylactic acid fiber according to the present invention shows an excellent high bulkiness and dimensional stability by the false-twist texturing. While conventional polylactic acid fiber has a poor ability to smoothly pass through processing steps in the false-twist texturing, the polylactic acid fiber according to the present invention can be subjected to the false-twist texturing with an excellent ability to smoothly pass through processing steps. This is because, as mentioned above, since the polylactic acid fiber according to the present invention has an improved shaving resistance owing to a low frictional factor, it can also endure the friction caused by twisting.

Figure 7:
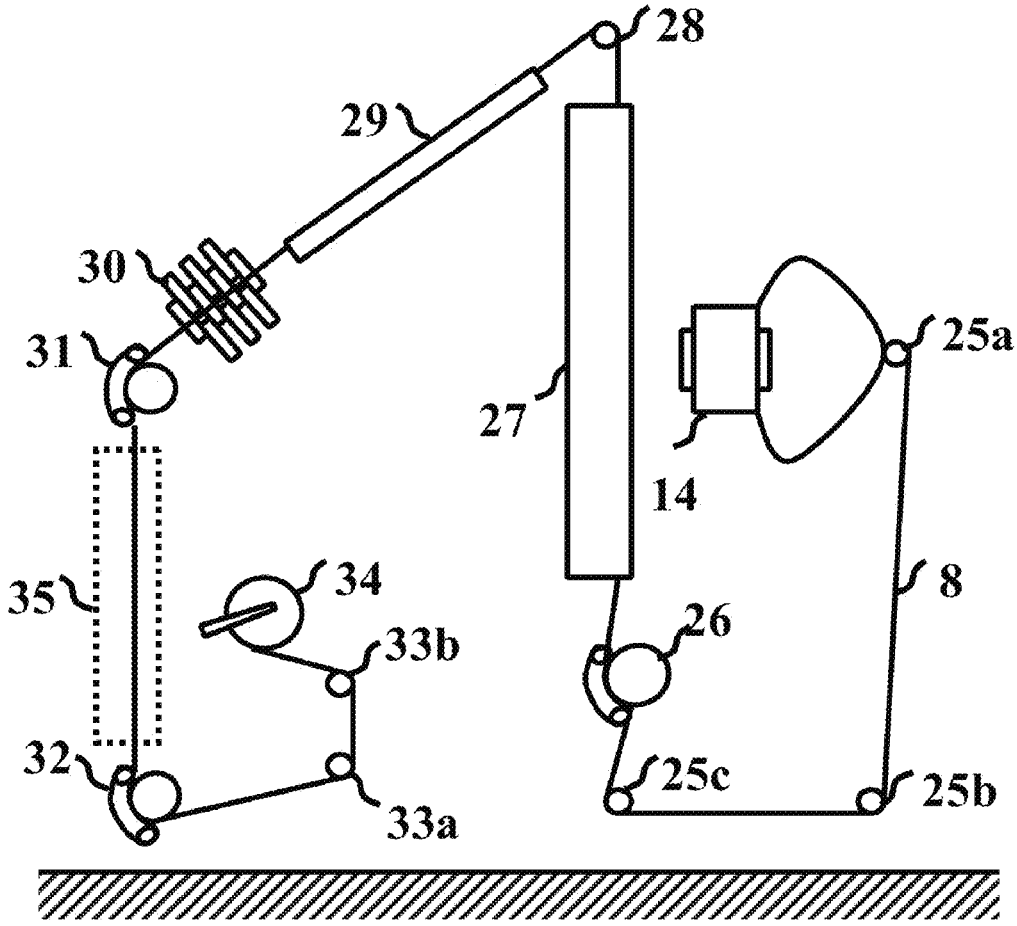
FIG. 7 is a schematic view of a drawing and false-twist texturing device used preferably for manufacturing the polylactic acid fibers of the present invention.

When the multi-filament composed of the polylactic acid fiber according to the present invention is subjected to the false-twist texturing, a draw false-twist texturing device can be employed, for example shown in FIG. 7. In FIG. 7, the multi-filament of the polylactic acid, which was supplied to the draw false-twist texturing device, is sent to a feed-roller 26 through desired yarn guides 25*a* to *c* and fluid treatment device. After that, through a false twist heater 27, which is heated, cooling plate 29 and a twisted body 30, which performs drawing friction false-twist texturing, the multi-filament is guided to a drawing roller 31, being rolled up as a false-twist textured yarn.

With regard to the false-twist texturing according to the present invention, the false-twist texturing can be performed after being subjected to the drawing by hot pins and hot plates before being sent to the feed roller 26 of the draw false-twist texturing device, or while being drawn between the feed roller and the drawing roller. Then, if a method is adopted, in which the false-twist texturing is performed while being drawn between the feed roller and the drawing roller, heat pins and hot plates are not required to arrange and extra charge for equipment can be cut low, therefore, it is preferable in that it has an excellent cost-performance it is preferable in that it has an excellent cost-performance.

Further, in the manufacturing method of the polylactic acid false-twist textured yarn according to the present invention, it also is a preferable embodiment that heat treatment is performed by arranging a heater and a delivery roller between the drawing roller and winder. By performing the heat treatment, the dimensional stability of the false-twist textured yarn of the polylactic acid fiber can further be enhanced. As for the heater, a contact heater and a non-contact heater can be employed. Moreover, if nip-roller and belt-nip devices are arranged in the delivery roller, it is preferable that yarns can be sufficiently handled. With regard to the ratio (VD/VE) between the circumferential speed (VE) of the drawing roller and that (VD) of the delivery roller, $0.8 \leqq VD/VE \leqq 1.0$ is preferable, because a stable heat treatment without yarn break can be performed. With regard to the temperature of the heater, when employing the contact heater, 100 to 250° C. is preferable in consideration of the efficiency of the heat treatment and the melting point of the polylactic acid. Further, when employing the non-contact heater, since the efficiency of the heat treatment is deteriorated compared with the contact heater, 150 to 350° C. is preferable in performing a sufficient heat treatment without yarn break.

With regard to the twisted body, a three-axis friction false-twist device and a belt-nip type friction false-twist device can be employed.

As for the disc of the three-axis friction false twist device, for example, urethane discs can be preferably used. By employing a flexible urethane for the surface of discs, excessive deformation and shaving of the polylactic acid fiber can be prevented. As for the hardness of the urethane disc, 75 to 90 degree according to JIS K6253 is preferable in that it prevents the polylactic acid fiber from being deformed and shaved excessively and the exchange period due to the disc wearing can be extended, and 80 to 85 degree is more preferable. If the number of discs is within the range of 5 to 12, it is preferable because the false-twist texturing can be performed easily.

Further, it is preferable to employ discs made of ceramics for part of discs of the three-axis friction false twist device. By doing so, when running the yarn-thread, the yarn-thread slips at the surface of the disc, so that an excessive tension would not be applied to the yarn-thread to prevent the yarn break by the shock when running the yarn. It is preferable that ceramics discs should be provided at the upstream and downstream edges against the running direction of the yarn-thread, and that 2 to 4 discs should be provided on the upstream side.

When adopting the belt nip type friction false-twisting device as a twisted body, chloropylene rubber and nitrile-butylene rubber (NBR) can be preferably used as the material of the belt. By doing so, an excessive deformation and shaving of the polylactic acid fiber can be prevented. Especially, NBR is more preferable from the point of view of durability, cost and flexibility. It is preferable that the belt hardness should be 60 to 72 degree measured by JIS K 6253 to keep a longer exchange period, and more preferable be 65 to 70 degree.

Further, as for the intersection angle of the belt, 90 to 120° is preferable in that the yarn can be sufficiently twisted and the belt wearing can be prevented.

Furthermore, it is referable that the ratio (the surface velocity of the twisted body/the running velocity of the yarn) between the surface velocity of the twisted body and the peripheral velocity of the drawing roller (which is called as the running velocity of the yarn) should be 1.0 to 2.5.

By making the ratio 1.0 or more, the twisting tension (T1) and untwisting tension (T2) are well-balanced and the drawing friction false-twist texturing, which does not cause the fluff and the yarn break, can be performed. Further, by making the ratio 2.5 or less, the surface wearing of the twisting body can be suppressed, the quality of the yarn in the longitudinal direction can be stabilized even under a continuous operation of several tens of hours and the yarn shaving is not caused by the wearing of the polylactic acid yarn-thread and twisting body. Then the false-twist texturing without the fluff and the yarn break, can be performed. The ratio is preferably 1.2 to 2.2, and more preferably 1.25 to 2.0. In addition, the surface velocity of the twisted body/the running velocity of the yarn-thread is denoted, in case of the disc false-twisting tool of the three-axis friction false-twisting type, as "D/Y", and in case of the belt nip type friction false twist device, as "VR".

Furthermore, in the false-twist texturing, which is preferably adopted by the present invention, it is preferable that the ratio (T2/T1) between the twisting tension (T1) and the untwisting tension (T2) should be 3.0 or less. By making T2/T1 3.0 or less, the occurrence of the fluff can be suppressed and it is possible to reduce the non-untwisted yarns. Therefore, a high-quality false-twist textured yarn can be obtained and a stabilized draw friction false-twist texturing becomes possible because the yarn break of the twisting body becomes scarce. It is preferable that T2/T1 should be 0.1 to 2.8, and more preferable be 0.5 to 2.5.

Further, in the false-twist texturing, it is preferable that the temperature of false-twist texturing (the temperature of the false-twisting heater 27 in FIG. 7) should be 90 to 150° C. By making the temperature 90° C. or higher, it is possible to give a sufficient dimensional stability to the obtained false-twist textured yarn, and by making the temperature 150° C. or lower, it is possible to perform a stable false-twist texturing without yarn break on the heater. Furthermore, because the deformation and thermal fixing by heat are well-balanced, the obtained false-twist textured yarn has a high quality of such as dimensional stability and crimp characteristics. It is preferable that the temperature of false-twist texturing should be 95 to 145° C., and more preferable be 100 to 140° C. The range of the temperature becomes especially preferable, when 4,000 to 7,000 m/min is adopted for the spinning speed, as mentioned above.

With regard to the polylactic acid fiber having the crimp by the false-twist texturing according to the present invention, it is preferable that the maximum point of the strength when performing a tensile test under an atmosphere of 90° C. (hereinafter abbreviated to 90° C. strength) should be 0.4 cN/dtex and more. By doing so, when used under a high-temperature atmosphere, the dimensional change of the product can be suppressed, that is, the dimensional change of the cloth in the starching process and drying process is small, having a favorable ability to smoothly pass through processing steps. It is more preferable that the 90° C. strength should be 0.5 cN/dtex or more, much more preferable be 0.6 cN/dtex or more, furthermore preferable be 0.8 cN/dtex or more.

Further, with regard to the polylactic acid fiber having a crimp by the false-twist texturing according to the present invention, it is preferable that the index of a crimp characteristic, CR value, should be 10% or more. By doing so, in the final product, a favorable high-bulkiness and high stretchability can be obtained. It is more preferable that CR value should be 15% or more, furthermore preferable be 20% or more.

Further, with the polylactic acid fiber having a crimp by the false-twist texturing according to the present invention, it is preferable that the non-untwisted number per 10 m of false-twist textured yarn should be 3 or less. By doing so, dyed cloth having an excellent uniformity of surface appearance and usefulness can be obtained. Furthermore, dyeing unevenness can be suppressed. It is preferable that the non-untwisted number should be one per 10 m or less, and more preferable be none per 10 m. In order to suppress the non-untwisted number in small, the ratio between the twisting tension and the untwisting tension should be adjusted by adjusting the ratio between the surface velocity of the twisted body and the circumferential speed of the drawing roller, as mentioned before.

A preferable embodiment of the polylactic acid fiber according to the present invention is to have a crimp by a fluid texturing process. The fluid texturing process can give a three-dimensional random high-crimp and the crimp can be given with a smaller damage to the yarn. Therefore, it is suitable for a carpet usage as for a method for providing a crimp because it is possible to obtain a crimped fiber of high tensile strength. As for methods for the fluid texturing process, for example, a jet-nozzle type and jet-stuffer type and the like can be adopted, however, above all, in order to provide a high crimp and manifest the crimp, the jet-nozzle type is preferable, for example, a crimping nozzle is preferably used, which is described in the U.S. Pat. No. 3,781,949. When employing the jet-nozzle method, for the purpose of fixing the crimp, like the description in, for example, Japanese Patent Laid-Open Publication No. 1993-321058, a cooling device, further a rotary filter can be combined.

As for the heating fluid for providing a crimp, a heating steam or heating air are preferably utilized, and the heating air is more preferable in that it reduces the damage to the yarn.

Regarding the temperature of the heating fluid applied to the yarn-thread, 130 to 210° C. is preferably adopted. The higher the temperature of the heating fluid, the bigger crimp characteristics can be applied to the crimped fiber, and there is a tendency that high bulkiness of the crimped fiber being enhanced, however, too higher temperature leads to the melting by heat of a single yarn or lowering of the strength of the crimped fiber.

With regard to the high-bulkiness yarn of the polylactic acid fiber, which was subjected to the fluid texturing process, it is preferable that the fineness of the constituent single fiber should be 3 to 35 dtex. By making the fineness 3 dtex or more, even for the application of carpets and the like, in which a load is applied, the wearing resistance and the working durability can be preserved. On the other hand, by making the single fiber fineness 35 dtex or less, without the compressive elasticity of the fiber being too large, soft texture and pleasant bulky yarn can be realized. Further, as long as within the above mentioned range of fineness, a combined filament yarn composed of a fine fineness fiber and thick fineness fiber is allowable. The single fiber fineness is more preferably 5 to 25 dtex.

Furthermore, with regard to the bulky yarn of the polylactic acid fiber according to the present invention, which is subjected to fluid texturing process, it is preferable that the total fineness should be 500 to 5,000 dtex. By doing so, it is possible to keep a highly efficient production in the setting process and tufting process in the manufacturing of the carpet. Moreover, by twisting two or three dyed-yarn and the like, which are dyed in different hue, a bulky yarn, is suitable for a carpet having a high coloring and luster. More preferable total fineness of the bulky yarn is 1,000 to 3,500 dtex.

Further, it is preferable that the bulky yarn of the polylactic acid fiber, which was subjected to fluid texturing process, has a crimping elongation of 3 to 35% after boiling-water processing. By making the value 3% or more, it is possible to obtain products such as a high-bulky carpet, without deteriorating the bulkiness of the bulky yarn even if it is subjected to heat treatment such as dyeing. Moreover, by making the value 35% or less, the lowering of the fiber strength can be suppressed, therefore, the products can be excellent in good process and durability for usage. More preferable crimping elongation is 8 to 25%.

Further, it is also preferable that the polylactic acid fiber according to the present invention has a shape of a staple fiber. In the shape, since smoothing properties are improved by containing a "specific fatty acid amide", the ability to smoothly pass through processing steps can be improved, and since the fiber opening property of the staple fiber and the dispersibility of the staple fiber in the fiber structure are improved, the manifestation of crimp and the quality are improved.

When producing the polylactic acid fiber according to the present invention as a staple fiber, the following steps are applied. The yarn-thread, which is melted and discharged, is, cooled, the oil agent being applied and takes up, and then alignment, drawing, and heat fixation are applied. By making the spinning speed 400 to 2,000 m/min and the draw times 1.5 to 6, the staple fiber of the polylactic acid fiber having a practical strength can be obtained. Alignment can be conducted by doubling a plurality of yarns, which were wound up, and once received in a banker, being continued to be finally a tow, whose total fineness is 50 to 1,000 thousands dtex. Further, in order to draw the tow uniformly, it is preferable to perform drawing in a bath using hot water of 75 to 100° C. and a steam drawing.

Then, according to applications, crimps are given to the drawn tow. As for a method for giving crimps, for example, a staffing box method, press-fit heating gear method, high-speed air injection press-fit method and the like are cited. As for the other methods for giving crimps, for example, for example, a method, in which a fiber is made to have an asymmetrical property along the direction of a section, and to manifest a spiral crimp created by the orientation difference at the time of drawing and the difference of the shrinkage rate created in the relax heat treatment after drawing and the like are cited.

As for the polylactic acid fiber according to the present invention having a shape of a staple fiber, it is preferable that the crimp number should be 6 crimps/25 mm or more, and at the same time, crimp ratio should be 10% or more. By doing so, products of a favorable texture having bulky and light feeling can be obtained. However, there is a tendency that the bulky properties are hard to manifest when crimps are excessively thin and the degree of crimp is too large, therefore, it is preferable that the crimps ratio should be 25 crimps/25 mm or less and the crimp ratio be 50% or less. It is more preferable that the crimp number should be 8 to 15 crimps per 25 mm and the crimp ratio should be 15 to 30%.

Further, the crimp shape of fiber may be a mechanical crimp or spiral crimp, though, in order to enhance bulkiness, the spiral crimp is preferable.

Furthermore, according to applications, it is preferable that oil agent is given as a finishing agent after drawing and crimps being given.

Then, the fiber is cut into a desired fiber length and the staple fiber can be obtained.

The fiber length of the staple fiber made of the polylactic acid fiber according to the present invention is preferably 5 to 120 mm, and more preferably 10 to 100 mm.

The single fiber fineness of the staple fiber made of the polylactic acid fiber according to the present invention is preferably 0.1 to 100 dtex, and more preferably 0.3 to 50 dtex. In general, the lowering of quality by the wearing of the polylactic acid fiber remarkably appears when the single fiber fineness is smaller, however, as for the staple fiber of the polylactic acid fiber according to the present invention, since the surface of the fiber has excellent smoothing properties, even if the single fiber fineness is small, staple fibers, which have sufficient wearing resistance and are high-grade, can be obtained.

Further, the polylactic acid fiber according to the present invention can be preferably applied to molding as a fiber binder of other fibers such as a natural fiber. In the application, since adhesive strength is greatly improved because of an excellent dispersibility due to favorable smoothing properties of the polylactic acid fiber according to the present invention, product having an excellent durability can be obtained. Furthermore, since the "specific fatty acid amide" contained in the polylactic acid fiber according to the present invention, especially fatty acid bisamide has a function to improve. The crystallization speed as a crystal nucleus agent, after molding and cooling, crystallization takes place rapidly, and it is possible to reduce a molding cycle.

For the binder application, it is preferable that in the polylactic acid fiber according to the present invention, the components comprising the fiber should have its exothermic peak in the crystallization in a temperature decrease, which is 100° C. or larger. It is shown that the higher the exothermic peak in the crystallization in a temperature decrease Tc', the faster the speed of crystallization, and in the polylactic acid fiber according to the present invention, by making Tc' 100° C. or higher, an excellent moldability is shown as a binder. More preferable Tc' is 120° C. or higher. Tc' can be measured in the DSC (Differential Scanning calorimetry) as an exothermic peak, when the temperature is decreased at a certain rate (16° C./min) after polylactic acid fiber according to the present invention is melted.

For the binder application, it is preferable that the polylactic acid fiber according to the present invention should have a lower melting point than usual in order to obtain a sufficient bind strength even in the low-temperature heat treatment.

As for means to have a lower melting point, as mentioned above, polylactic acid having low optical purity is used, and in addition, copolymerization polylactic acid may be used. Regarding the fiber to be bound for the binder application, for example, glass fiber, carbon fiber, synthetic fibers such as polyethylene terephthalate, nylon, acrylic and polyolefin and plant fiber and the like can be cited. Further, as mentioned above, in the case of the polylactic acid fiber, whose melting point is lower than usual, the polylactic acid fiber having a higher optical purity or a lower copolymerization rate and relatively high melting point can be used.

Then, the yarn package according to the present invention is characterized in that the polylactic acid fiber according to the present invention, having a shape of a filament, is wound.

Regarding the yarn package according to the present invention, it is preferable that the saddle (the tight selvage) should be 7 mm or less. The unreeling speed required by drawing, false-twist, weaving and the like amounts to 500 to 1,000 m/min, however, by making the saddle 7 mm or less, the scratch on the unreeled yarn-thread and saddle part and shaving on the surface of the polylactic acid fiber can be suppressed. In addition, defects due to the shaving are caused in correspond with the package edge period (corresponding to the length of yarn from a saddle to the other one). Further, in the saddle part the unreeling tension of the yarn is tend to fluctuate, however, it is possible to suppress this and a stable yarn processing can be conducted. It is more preferable that the saddle should be 5 mm or less, and furthermore preferable be 3 mm or less.

Moreover, regarding the yarn package according to the present invention, it is preferable that a bulge (swell) should be smaller, more specifically, bulge rate be 10% or less. By doing so, the unreeling tension can be suppressed. The bulge rate should more preferably be 7% or less, and further more preferably 5% or less.

In order to remove the saddle and bulge, it is effective to wind up in a relaxed state, so that the internal strain of the fiber is removed by adjusting the winding tension, as mentioned above. Further, regarding the yarn package according to the present invention, it is preferable that the fiber weight per one package should be 4 kg or more. By doing so, the package replacement cycle in the process for processing the yarn can be reduced to enhance the productivity. It is more preferable that the fiber weight per one package should be 7 kg or more.

Then, fiber products according to the present invention are characterized in that the polylactic acid fiber according to the present invention is used, at least in a part of them.

With regard to the fiber products according to the present invention, there are various shapes, such as woven goods, knitted goods, nonwoven clothes, spun yarn, cotton pad, carpet.

Further, in the fiber products according to the present invention, the polylactic acid fiber according to the present invention, can be independently used, or combined applications with other fibers is possible, such as combined filament, combined weaving, combined knitting. As for a partner fiber to be combined, for example, biodegradable fiber such as polyglycolic acid, polyhydroxy butylate, polybutylene succinate, poly caprolactone, natural fiber such as cotton, silk, hemp, wool, regenerated fiber such as rayon, acetate, synthetic fiber such as polyethylene terephthalate, nylon, acrylic, vinylon, polyolefin, polyurethane can be adopted. Fibers made of materials derived from plants, such as silk, cotton, hemp, rayon have totally excellent texture and biodegradability, and are preferable. Nonwoven fabric is one of the preferable embodiments of fiber products according to the present invention. When producing fiber products according to the present invention as nonwoven fabrics, the staple fiber of the polylactic acid fabric according to the present invention can be used, or a method, in which spinning, such as, what is called, spun-bond and melt-blown and the formation process of nonwoven clothes are in a row, may be used.

For example, when employing the staple fiber of the polylactic acid fiber according to the present invention, the staple fiber has excellent smoothing properties, and it is extremely favorable in fiber opening property in fiber opening machines and card machines, therefore, when the polylactic acid fiber is independently used or combined with other fibers, a even web can be manufactured. Therefore, nonwoven fabrics, which can be obtained by the thermal bonding process of these, have little density unevenness, and becomes of higher grade.

When forming staple fibers of polylactic acid fibers of the present invention into nonwoven fabric, it is preferable to use 0.3 to 100 dtex and 10 to 100 mm as single fiber fineness and fiber length respectively, because it can then be used in a variety of applications.

Moreover, it is preferable that the weight of the nonwoven fabric be 10 to 5,000 g/m$^2$ because it can be used in various applications.

Spun yarn is also one of the preferable fiber product modes of the present invention. Because the staple fiber of the polylactic acid fiber of the present invention has superior sliding properties, it is able to smoothly pass through the spinning processes such as knead sliver, roving and fine spinning, and it is possible to obtain a high-quality spun yarn with little thickness unevenness, twisting unevenness, pile, physical property dispersion, and dyeing unevenness.

It is preferable to use at least some of the present inventions polylactic acid staple fiber in spun yarn with a modified cross section because it improves the texture and bulge of the spun yarn.

Moreover, it is preferable to use 0.5 to 10.0 dtex and 3 to 100 mm as single fiber fineness and fiber length respectively of this inventions polylactic acid staple fiber in spun yarn when independently using staple fibers of polylactic acid fibers because it has good property to pass through the spinning process. Moreover, concerning single fiber fineness and fiber length, it is preferable to use 1.0 to 1.55 dtex and 30 to 50 mm when mixing the staple fiber of polylactic acid fiber with cotton, 1.0 to 3.0 dtex and 70 to 90 mm when combed-wool-spinning the staple fiber with wool, and 3.0 to 7.0 dtex and 30 to 50 mm when carded-wool-spinning the staple fiber with wool.

As to the fiber fineness of the spun yarn, 10 to 500 dtex is preferable as it is then widely applicable. Moreover, properly using twist in the spun-yarn manufacturing process is also preferable because it is possible to improve the texture, design property, and strength of the spun yarn.

Cotton pad is also a fiber product mode of the present invention. Because staple fibers of the polylactic acid fiber of the present invention have superior sliding properties, they are uniformly immersed in the cotton pad and it is possible to use the staple fibers in high-quality cotton pad with very little density unevenness.

Regarding the single fiber fineness of the staple fiber of polylactic acid fiber when used in cotton pad, 3 dtex or more is preferable because compression resistance can be improved. In the case of the single fiber fineness of the cotton pad, 50 dtex or less is preferable because it controls the hard feeling of the cotton pad. As to the single fiber fineness of cotton pad, 20 dtex or less is more preferable.

Moreover, it is preferable to supply 0.3 to 1.0 wt % of a smoothing agent such as silicon to fibers that constitute cotton pad because greater softness feeling can be provided.

Furthermore, it is preferable that fiber product cotton pad of the present invention has a bulkiness of 50 cm$^3$/g or more. Thereby, the cotton pad has a high void ratio. For example, when using the cotton pad in a mattress, the heat retaining property of the mattress is improved and the mattress is more satisfactory. From the viewpoint of the heat retaining property when used in a mattress, a bulkiness of 60 cm$^3$/g or more is preferable, with 100 cm$^3$/g or more even better. As bulkiness increases, the lightness and heat retaining property is improved.

Furthermore, it is preferable that cotton pad has compressibility of 45% or more. In this case, the compressibility denotes an index for showing the bulkiness when the cotton pad is compressed. By setting the compressibility to 45% or more, it is possible to hold the bulkiness against a compressive load and also the aforementioned heat retaining property. Compressibility of 50% or more is preferable and 60% or more is further preferable. On the other hand, compressibility is preferably 90% or less to prevent hard feeling due to excessive compressibility.

Furthermore, it is preferable that batting has a recovery rate of 70% or more because a resilient feeling is obtained. The recover rate denotes an index for showing the degree of bulk recovery when the load was removed from a cotton pad after a load was applied to compress the cotton pad. Because polylactic acid staples of the present invention have superior sliding properties, tangles and engagements between stables are decreased. Thereby, resilient cotton pad with high recovery rate is obtained. A recovery rate of 85% or more is preferable and even more preferable as it increases.

Moreover, a carpet is a preferable fiber product mode of the present invention. When using polylactic acid fibers of this invention for a carpet, for example, it is preferable to set the spinning speed to 400 to 2,000 m/min, the draw magnification to 1.5 to 6 times, and apply yarn crimping.

As to drawing, a steam treating apparatus may be secondarily used together in order to fix a drawing point. Moreover, the drawing method may be either one stage or multistage.

It is allowed to spin, draw and crimp the fibers either continuously without temporarily winding them or supply them to the subsequent step after temporarily winding them at the state of undrawn yarn or drawn yarn.

The following are used as crimping methods: mechanical crimping by gears, crimping by asymmetric heat-treatment, crimping by false twisting, and crimping by fluid texturing process.

By using thus obtained crimped yarn of polylactic acid fibers as the raw fabric for at least a part of a pile, for example, in a carpet in a woven carpet process such as Wilton, double face or Axminster, an embroidery carpet process such as tufted or hooked rug, an adhesive carpet process such as bonded, electrodeposition or cord, and a knitted carpet process such as knit and Raschel, dyeing the yarn as necessary, it is possible to obtain a carpet as one mode of fiber products of the present invention.

When performing dyeing, the raw fabric of the carpet may be dyed before the process. When performing dyeing before the carpet-raw-fabric manufacturing process, it is allowed to dye yarns by conventional ways of cheese dyeing or hank dyeing to manufacture carpet raw fabric using the yarn-dyed yarns.

Carpet may be blended with an antistatic yarn, monofilament or other yarn in order to improve the antistatic property or design property.

To obtain a carpet rich in voluminous feeling at a lower cost, it is preferable to form a tufting carpet composed of a face yarn in a form of a pile and ground fabric obtained by tufting the face yarn. In this case, in order to further improve the environmental-load decreasing effect, it is also preferable not only to use a crimped yarn of polylactic acid fiber for the piled face yarn but also to compose of a part of the ground fabric, preferably 50% or more of the ground fabric with aliphatic polyester fiber such as polylactic acid fiber or natural fiber. From a viewpoint of the biodegradability of the whole carpet, it is also preferable to use polylactic acid fiber mainly for the fiber composing of the ground fabric.

A staple fiber nonwoven fabric obtained by a needle band method, a long-fiber nonwoven fabric obtained by a spunbond method or a flash spinning method or a woven ground fabric obtained by a weaving method may be used for the ground fabric of a tufted carpet. However, it is preferable to use a long-fiber nonwoven fabric or woven ground fabric in order to improve the ground fabric strength necessary for tufting and product strength.

Though a level cut style or a level loop style may be applied to the tufted carpet, a cut and loop may also be applied to further improve the design property. Though it is allowed to properly set the pile height in accordance with the purpose, a range between 3 and 30 mm is preferable and a range between 10 and 20 mm is more preferable.

Then, backing is applied to the tufted carpet by a conventional method. In this case, it is also preferable to add shirring to the carpet in accordance with the purpose.

Moreover, it is preferable to apply a stain-proofing agent to the carpet in order to improve the stain resistance.

It is preferable that the fiber product of the present invention is third class or higher in dry friction solidity degree and second class or higher in wet friction solidity degree. Thereby, it can be in practical use. Color fastness test to friction can be evaluated by a friction tester type-II (vibration learning type) in accordance with JIS L 0849. In the evaluation method, a dyed fiber product is rubbed by a cotton cloth to evaluate the color migration from the fiber product to the cotton cloth. It is more preferable that the dry friction solidity degree and the wet friction solidity degree are both third class or higher.

When applying a color fastness test to a conventional fabric constituted by 100% of polylactic acid fiber, it clears third class in washing and light resistance test but it becomes very bad first class in dry and wet color fastnesses. However, in the case of polyethylene terephthalate or nylon, the fastness to friction reached fourth class or higher as long as a general dye is used.

Polylactic acid fiber of the present invention can be used not only for garment purposes such as shirt, blouson, pants, coat, jumper, suit, blazer, jacket, dress, sweater, cardigan, skirt, blouse, sweat suit, sportswear, uniform, inner wear, socks, tights, hat, muffler, gloves and belly band but also for garment material purposes such as cup, pad, sewing thread, fastener and backing cloth, material purposes such as handkerchief, towel and bleached cotton, interior purposes such as curtain, carpet, mat, wall paper and furniture, vehicle parts purposes, industrial material purposes such as batting for cushion material and stuffed toy, belt, net, rope, heavy cloth, bags, sewing thread, and felt, nonwoven fabric, filter and artificial grass. Moreover, when using the polylactic acid fiber as a binder fiber, it is preferable to be used for paper, nonwoven fabric, cushion material, heat-pressure molding board, and spun yarn and can be used as agricultural forestry and fishery material, civil engineering and construction material, sleeping material, living material, automobile material and garment material.

Moreover, a nonwoven fabric of a fiber product of the present invention is preferably used for hygienic purposes such as diaper and sanitary product, material purposes such as cushion, wiping cloth, table cloth, filter, tea bag, cutwater garbage bag, shoe and bag and packaging purposes.

EXAMPLES

Measuring Method (1) Weight-Average Molecular Weight

Polystyrene was measured as a standard by using a gel permeation chromatography "Shimadzu LC-10AD" made by Shimadzu Corp.

(2) Residual Lactide Quantity

One gram of a sample was dissolved in 20 ml of dichloromethane and 5 ml of acetone was added to the solution. Then, the solution was set to a constant volume together with cyclohexane and precipitated to be analyzed by liquid chromatography using GC17A made by Shimadzu Corp. and the lactide content was measured by an absolute calibration curve.

(3) Carboxyl End Group Concentration

After an precisely weighed sample was dissolved in o-cresol (moisture of 5%) and a proper amount of dichloromethane was added to the solution, the carboxyl end group concentration was measured by titration using 0.02-normal KOH methanol solution. In this case, oligomer such as lactide, which is a cyclic dimer of lactic acid, hydrolyzes to produce a carboxyl end group. Therefore, a carboxyl end group concentration is obtained by totalizing the carboxyl end group of polymer, carboxyl end group derived from monomer and carboxyl end group derived from oligomer.

(4) Spinning Property

The number of yarn breaks under a spinning test of it was examined. Four times/t of yarn breaks or less were accepted.

(5) Drawing Property

A drawing by 3 kg/spindle was performed by a draw machine mounted 144 spindles to evaluate the drawing property according to the following expression. A drawing superiority ratio of 90% or more is accepted.

Drawing superiority ratio (%)=[Number of set spindles−number of yarn-breakage spindles−number of spindles in which a yarn is wound on a roller/number of set spindles]×100

(6) Strength and Elongation

A load elongation curve was obtained by using "Tensilon UTM-100III" made by Orientec Co., at room temperature (25° C.) setting the initial sample length to 200 mm and the tensile speed to 200 mm/min. Then, a maximum load value was divided by the initial fiber fineness to be the strength and the elongation at the maximum load was divided by the initial sample length to be a elongation. (Conforming to JIS L 1015)

(7) Boiling Water Shrinkage Rate

The boiling water shrinkage rate was obtained from the following expression.

$$\text{Boiling water shrinkage rate (\%)}=[(L0-L1)/L0]\times 100$$

L0: Original length of a hank measured at an initial load of 0.088 cN/dtex after applying the hank to a yarn to be measured.

L1: Length of the hank measured at initial load of 0.088 cN/dtex after the hank whose L0 had been measured was treated in boiling water for 15 min. under a substantially load free condition and wind-dried (8) U %

U % is measured by using "Uster Tester 1 MODEL C" made by Zellweger Uster Inc. at a yarn speed of 200 m/min in normal mode for 1 min as the measuring time.

(9) Cross-Sectional Modification Degree

After a yarn was cut to show the cross section, the cross-sectional modification degree of the yarn was obtained from the diameter D of a circumscribed circle and the diameter d of an inscribed circle d of single-yarn cross section in accordance with the following expression.

modification degree=$D/d$

(10) Color Tone (b* Value)

A b* value was measured by laminating and winding a fiber sample on a transparent plate up to a degree in which the color of a base material can be almost ignored by using the "Spectrophotometer CM-3700d" made by MINOLTA CO., LTD. In this case, $D_{65}$ (color temperature of 6504K) was used as a light source and measurement was performed at a visual field of 10°.

(11) D/Y and VR in False Twist Texturing

The rotating speed (S) of a twisted body at the time of false twist was measured by a stroboscope, the twisted-object surface speed (S×LL) was obtained from the peripheral length (LL) of the twisted body, and the speed of a draw roller was set to a filament speed (Y) to calculate D/Y and VR.

Triaxial-friction-false-twist-type disk false twisting tool: $D/Y=(S\times LL)/Y$ Belt-nip-type friction false twisting tool: $VR=(S\times LL)/Y$

(12) Strength at 90° C.

A load-elongation curve was obtained under the condition shown in JIS L 1013 at a heating atmosphere (90° C.) by setting an initial sample length to 200 mm and a tensile speed to 200 mm/min. A maximum-point load value was divided by an initial fineness to use the obtained value as 90° C. strength.

(13) Non-Untwisted Number

A false twisted yarn was drawn by 10 m and the number of non-untwisted portions was counted to use the counted value as an non-untwisted number.

(14) CR Value of False Twisted Yarn

A false twisted yarn reeled into a hank was treated for 15 min in boiling water under a substantially load-free state, and air-dried for 24 hr. A load equivalent to 0.088 cN/dtex (0.1 gf/d) was applied to the sample and immersed in water to measure the hank length L' after 2 min. Then, a hank equivalent to 0.088 cN/dtex was removed in the water and replaced by a light load equivalent to 0.0018 cN/dtex (2 mgf/d) to measure the hank length L'1 after two min. Then, a CR value was calculated in accordance with the following expression.

$CR(\%)=[(L'0-L'1)/L'0]\times 100(\%)$

(15) Crimp Elongation Rate of Crimped Yarn for Carpet

A crimped yarn unreeled from a package left as it is for 20 hr or more in an atmosphere at a room temperature of 25 to 35° C. and a relative humidity of 50 to 75% was immersed in boiling water for 30 min under a non-load state and then, dried up to an equilibrium moisture rate. An initial load of 2 mg/dtex was applied to the sample yarn and marked at a position of sample length of 50 cm (L1) after 30 sec past. Then, a constant load of 100 mg/dtex was applied to the sample to obtain a crimp elongation rate from a sample length (L2) at the marking position in accordance with the following expression.

Crimp elongation rate (%)=$[(L2-L1)/L2]\times 100$

The atmospheric condition when leaving a filament as it is before treated with boiling water was a state of a crimped yarn when used in an actual carpet manufacturing process. That is, a state when a crimping characteristic reached an equilibrium state due to moisture absorption was assumed. Therefore, a condition in which it does not require too much time to reach an equilibrium state and dew condensation does not occur is selected.

(16) Crimped Unevenness

A fiber sample is wound on a transparent plate to visually evaluate the crimped unevenness as follows.

◎: Crimped unevenness was found little.

○: Crimped unevenness was found a little.

Δ: Crimped unevenness was found much.

x: Crimped unevenness was found very much.

(17) Weaving Property

The number of stop times of a loom due to yarn breaks was checked when operating a WJR (water jet loom) at a loom rotational speed of 600 to 800 rpm. It is accepted that the number of stop times of the loom is 6/day·loom or less.

(18) Bulkiness, Compression Ratio, and Recovery Ratio of Staple Fiber Raw Cotton They conform to JIS L 1097.

(19) Sliding Properties of Staple Fiber Raw Cotton

The disentangling easiness when disentangling raw cotton by hands was evaluated by the following indexes.

◎: very easily disentangled

○: easily disentangled

Δ: not easily disentangled x: hardly disentangled

(20) Friction Solidity

After reciprocatively rubbing a dyed cloth sample 100 times, the color transfer degree to cotton cloth was determined at first to fifth classes by using a gray scale. (Conforming to JIS L 0849)

(21) Wearing Resistance Evaluation

The wearing resistance of a dyed cloth was evaluated by the following treatment conditions in accordance with the Taper method by JIS L 1018, visually observing the surface wearing state. In this case, three grade evaluation was performed by assuming that a sample with almost no wearing was ◎, a sample with a slight wearing was ○ and a sample with significant wearing was x, and samples with ○ or better were accepted.

Abrasive media: No. CS-10

Pressing load: 2.45 N

Number of times of friction: 200

(22) Dyeing Variety

A dyed cloth was visually evaluated. Samples evaluated to be ○ or better were accepted.

◎: No dyeing unevenness was recognized.

○: A slight dyeing unevenness was recognized.

Δ: Dyeing unevenness was conspicuous.

x: Dyeing unevenness was significant.

(23) Gloss of Carpet

The gloss of a dyed carpet was visually evaluated as follows.

◎: Having sufficient gloss

○: Having gloss

Δ: Having insufficient gloss x: Having no gloss

(24) Bulkiness of Carpet

A dyed carpet was put under sunlight to evaluate bulkiness of the carpet as follows by observing the degree of substrate loss.

◎: No substrate spot was recognized at all and the bulkiness was very good.

○: Substrate spot was hardly recognized and bulkiness was good.

Δ: Substrate spot was recognized and bulkiness was slightly insufficient.

x: Much substrate loss was recognized and bulkiness was considerably insufficient.

(25) Texture

Texture of a dyed carpet was sensorily evaluated as follows by touching the dyed carpet by hand.

◎: Softness and resiliency were very good.

○: Softness and resiliency were good.

Δ: Softness and resiliency were slightly insufficient.

x: Softness and resiliency were considerably insufficient.

(26) Durability

A dyed carpet was used as an entrance mat of an office for one year and then the appearance of the carpet was visually evaluated as follows.

◎: Appearance change was hardly found and durability was good.

○: Though slight appearance change was found, durability was kept at a level without a problem.

Δ: Roughness due to abrasion was found on the surface and slight whitening, shine and fatigue were also found.

x: Significant roughness due to strong abrasion was found on the surface. Moreover, lots of whitening, shine and fatigue were found and even a part with a hole caused by wearing was present.

(27) Actual U % and Theoretical U % of Spun Yarn

U % was measured in a cotton mode by using KET80B made by KEISANKI KOGYO Co., Ltd.

The theoretical U % of a spun yarn was calculated in accordance with the following expression.

$$\text{Theoretical } U\% = 80/(n)^{1/2}$$

n: Number of component fibers=Total fineness/single yarn fineness

(28) Coefficient I of Spun Yarn

Calculated in accordance with the following expression.

$$\text{coefficient } I = \text{Actual } U\%/\text{theoretical } U\%$$

(29) Strength of Spun Yarn

Conforms to JIS L 1095.

(30) Appearance Quality of Spun Yarn

Visually evaluated in accordance with the following indexes from twisting unevenness and pile state.

○: A spun yarn had a preferable appearance quality because twisting unevenness and piles were slight.

Δ: Though twisting unevenness and pile were slightly present, appearance quality was passably accepted.

x: Lots of twisting unevenness and pile were present and appearance quality is unaccepted.

(31) Tensile Strength of Unwoven Fabric

Measured five times in warp direction and weft direction respectively in accordance with JIS L 1095 and obtained in accordance with the following expression.

$$\text{Tearing strength} = (\text{Tearing strength in warp direction} + \text{tearing strength in weft direction})/2$$

(32) Bending Strength of Board

Conforms to JIS K 7062.

[Manufacturing of Polylactic Acid]

(Polylactic Acid P1)

Lactide manufactured from L lactic acid having an optical purity of 99.5% is polymerized at 180° C. for 140 min in a nitrogen atmosphere in which bis(2-ethylhexanoate) tin catalyst (molar ratio of lactide to catalyst=10,000:1) is present to obtain polylactic acid P1. The weight-average molecular weight of the polylactic acid P1 is 145,000, the remaining lactide quantity is 0.09 wt %, and carboxyl end group concentration is 19 eq/t.

(Polylactic Acid P2) (Polylactic Acid Containing 4 Wt % of EBA)

Polylactic acid P2 containing 4 wt % of EBA is obtained by drying P1 and ethylenebisstearic acid amide (EBA) ["ARUFUROH-50S" made by NOF Corporation, melting point of 144° C.], measuring EBA heated and melted so that P1:EBA becomes 96:4 (weight ratio), and supplying the EBA to a double-axial kneading extruder having a cylinder temperature of 220° C. while continuously adding the EBA to P1.

(Polylactic Acid P3) (Polylactic Acid Containing 7 Wt % of KBA)

Polylactic acid P3 containing 7 wt % of EBA is obtained in the same manner as manufacturing of P2 except to change to P1:EBA=93:7 (weight ratio).

(Polylactic Acid P4) (Polylactic Acid Containing 4 Wt % of KBA)

Polylactic Acid P4 Containing 4 wt % of KBA in the same manner as manufacturing of P2 except to change EBA to m-xylylenebisstearic acid amide (KBA) ["SLIPAX PXS" made by Nippon Kasei Chemical Co., Ltd., melting point: 123° C.].

(Polylactic Acid P5) (Polylactic Acid Containing 4 Wt % of SS)

Polylactic acid P5 containing 4 wt % of SS is obtained in the same manner as manufacturing of P2 except to change EBA to N-stearyl stearic acid amide (SS) ["NIKKAMID S" made by Nippon Kasei Chemical Co., Ltd., melting point: 95° C.] which is alky-substituted-type monoamide.

(Polylactic Acid P6) (Polylactic Acid Containing 4 Wt % of BA)

Polylactic acid P6 containing 4 wt % of BA is obtained in the same manner as manufacturing of P2 except to change EBA to behenic acid amide (BA) which is monoamide ["ARUFURO B-10" made by NOF Corporation, melting point: 110° C.].

(Polylactic Acid P7) (Polylactic Acid Containing 4 Wt % of SA)

Polylactic acid P7 containing 4 wt % of SA is obtained in the same manner as manufacturing of P2 except to change EBA to stearic acid amide (SA) which is monoamide [ARUFURO S-10 made by NOF Corporation, melting point: 100° C.].

Example 1

Polylactic acid is chip-blended (1 wt % of EBA) so that P1:P2 becomes 3:1 in weight ratio and set to a hopper 1, the chip is melted by an extruder 2 at 220° C., then polymer is weighed by a weighing pump 3 in a spin block 4 heated up to 220° C., and the melted polymer is led to a spinning pack 5 and discharged from a spinneret (discharge hole diameter of 0.25 mm and hole depth of 0.75 mm) having 36 discharge holes (FIG. 4).

In this case, the stay time of the polymer from melting to spinning is approx. 10 min. Moreover, smoking immediately under the spinneret is hardly produced.

Spun yarn-thread 8 are cooled and solidified with cooling wind having wind speed of 25 m/min at an atmospheric temperature of 25° C. through a cooling device 7 and converged, and a spinning oil agent (emulsion concentration of 15%) containing 40 wt % of a fatty-acid-ester smoothing agent (20 wt % of isotridecylstearate+20 wt % of octylpalmitate) is applied to fiber through the oil feed guide so that the purity content of oiling agent becomes 1 wt %, and entanglement is conferred by an entangling device 10. Then, the yarn is taken up by an unheated first take-up roller 11 at a circumferential speed of 3,000 m/min and then wound by a winder 13 through an unheated second take-up roller 12 at a circumferential speed of 3,015 m/min to obtain a wind-up yarn package 14. The yarn-thread tension for winding is 0.08 cN/dtex. Moreover, the spinning property is preferable and yarn break or fluff is not found.

The obtained undrawn yarn 14 is preheated by a first hot roller 16 at 90° C. through a feed roller 15 and then, drawn to 1.45 times, heat-set by a second hot roller 17 at 130° C., and wound up through a cold roller 18 to obtain a an undrawn-yarn package 20 (FIG. 5) having a circular cross-section and 84 dtex and 36 filaments. The drawing property is preferable and the draw superiority ratio is 98%, and attachment of fluff to guides is not found.

The obtained fiber shows preferable yarn properties such as carboxyl end group concentration of 23 eq/t, temperature of crystallization in a temperature decrease Tc' of 126° C., strength of 3.5 cN/dtex, elongation of 38%, boiling water shrinkage rate of 7.0%, and U % of 0.7%. Moreover, b*value is 1.2 which is a preferable color tone because it hardly shows a tincture of yellow.

By using the drawn yarn for a warp and a weft, a flat textile (number of yarns per c $m^2$: 95 warps/2.54 cm, 80 wefts/2.54 cm) is manufactured. S twist of 300 turns is applied to warps. In this case, yarn break or fluff is hardly occurred in the twisting process and weaving process in this case and an excellent ability to smoothly pass through weaving process is shown.

Moreover, the cloth is subjected to dyeing process in accordance with the following conditions.

Refining: Soda ash (1 g/l), Surface-active agent (0.5 g/l), 98° C.×20 min

Intermediate set: 140° C.×3 min

Dyeing: Dianix Navy Blue ERPS 200 (2% owf), ph adjuster (0.2 g/l), 110° C.×40 min Soaping: Surface-active agent (0.2 g/l), 60° C.×20 min Finishing set: 140° C.×3 min The obtained cloth shows excellent texture because it has less mechanical creak peculiar to polylactic acid fiber though it is ductile and soft. Moreover, the cloth has a excellent quality because it is excellent in color developability and has less dyeing unevenness. Furthermore, the cloth is excellent in wearing resistance because the dry friction solidity degree and wet friction solidity degree are fourth grade. Furthermore, as a result of observing the surface of the cloth by an SEM after a friction test, wearing of yarns hardly occurs (FIG. 1).

Industrial cutting and industrial sewing are performed by using the dyed cloth. No melt occurs at a cloth cutting portion when the cloth is cut, soiling of sewing machine needle is slight, and excellent ability to smoothly pass through processing steps is shown. As a result of performing a durability test in which a shirt is manufactured by using the cut cloth and wore for one month, fluffing, whitening, or shine does not occur and excellent product durability is shown.

Example 2

A drawn yarn having trifoiled section having 84 dtex and 36 filaments is obtained by performing melt spinning and drawing in the same manner as the case of the example 1 except to use only P2 as polylactic acid (4 wt % of EBA) and a spinneret having 36 Y-shaped discharge holes.

In spinning, the stay time of polymer from melting up to spinning is approx. 10 min. Moreover, because the content of EBA is 4 wt % which is larger than the case of the example 1, smoking is observed immediately under the spinneret, though it does not become a problem. Furthermore, the spinning property is preferable and yarn break or fluff is not found.

Furthermore, the drawing property is preferable, the draw superiority ratio is 98% or more, and attachment of fluff to guides is not found. Obtained fiber shows preferable yarn properties such as a carboxyl end group concentration of 24 eq/t, temperature of crystallization in a temperature decrease Tc' of 127° C., strength of 3.1 cN/dtex, elongation of 30%, boiling water shrinkage rate of 6.0%, and U % of 1.5%. However, the b*value of a drawn yarn is higher than the case of the example 1 and it has a little tincture of yellow though this does not become a problem.

A flat textile is manufactured by using the drawn yarn in the same manner as the case of the example 1. In this case, yarn break or fluff is hardly occurred in the twisting process and the weaving process and an excellent ability to smoothly pass though weaving process is shown.

The cloth is subjected to dyeing process in the same manner as the case of the example 1. The obtained cloth shows an excellent texture having less mechanical creak peculiar to polylactic acid fiber though it is ductile and soft. Moreover, slight dyeing unevenness is found compared to the case of the example 1 because the U % of a yarn is larger than the case of the example 1 and slight coherence of EBA is present though the cloth is excellent in color developability. Furthermore, because the dry friction solidity degree and wet friction solidity degree are fifth grade. Therefore, the cloth is excellent in wearing resistance.

By using the dyed cloth, industrial cutting and industrial sewing are performed. There is not melt on a cloth cutting portion when the cloth is cut, soiling of a sewing machine needle is slight, and an excellent ability to smoothly pass through processing steps is shown. As a result of manufacturing a shirt by using the cut cloth and performing a durability test in which the shirt is wore for one month, an excellent product durability is shown because there is no fluff, whitening, or shine.

Example 3

A drawn yarn having 84 dtex and 36 filaments is obtained by performing melt spinning and drawing in the same manner as the case of the example 1 except to use polylactic acid in which the setting ratio P1:P2 becomes 12.3:1 (0.3 wt % of EBA) in weight ratio.

In spinning, the stay time of polymer from melting to spinning is approx. 10 min. The drawing property is preferable and yarn break or fluff is not found.

Moreover, the drawing property is preferable and the draw superiority ratio 98% or more and attachment of fluff to guides is not found. The obtained fiber shows preferable yarn properties such as a carboxyl end group concentration of 22 eq/t, temperature of crystallization in a temperature decrease Tc' of 121° C., strength of 3.6 cN/dtex, elongation of 39%, boiling water shrinkage rate of 7.5%, and U % of 0.7%. Moreover, the b*value is 0.8 which is a preferable color tone because it hardly shows a tincture of yellow.

By using the drawn yarn, a flat textile is manufactured in the same manner as the case of the example 1. In this case, yarn break or fluff hardly occurs in the twisting process and waving process and an excellent ability to smoothly pass through processing steps is shown.

The cloth is subjected to dyeing processing in the same manner as the case of the example 1. The obtained cloth shows a ductile and soft excellent texture. However, because the content of EBA is smaller than the case of the example 1, a mechanical creak peculiar to polylactic acid is slightly left. Moreover, the cloth shows a excellent quality because it is excellent in color developability and has no dyeing unevenness. Furthermore, dry friction solidity degree and wet friction solidity degree are third grade which is an acceptable level. However, the wearing resistance is inferior to the case of the example 1.

By using the dyed cloth, industrial cutting and industrial sewing are performed. Melt at the cloth cutting portion when the cloth is cut slightly occurs compared to the case of the example 1. Moreover, slight soiling of a sewing machine needle is found. However, a sufficient ability to smoothly pass through processing steps is shown. As a result of performing a durability test in which a shirt is manufactured by using the cut cloth and wore for one month, fluff, whitening, and shine are slight though they are inferior to the case of the example 1 and a sufficient product durability is shown.

Example 4

A drawn yarn having 84 dtex and 24 filaments is obtained by performing melt spinning and drawing in the same manner as the case of the example 1 except to use a spinneret having 24 discharge holes (discharge hole diameter of 0.28 mm and hole depth of 0.75 mm) and change a discharge quantity, and taking up at the circumferential speed of a first take-up roller to 5,000 m/min and that of a second take-up roller to 5,025 m/min, and change the temperature of a first hot roller to 140° C. and the draw magnification to 1.65 times and the temperature of a second hot roller to 150° C.

In spinning, the stay time of polymer from melting to spinning is approx. 6 min. Moreover, the spinning property is preferable and no yarn break or fluff is found.

Furthermore, the drawing property is also preferable, the draw superiority ratio is 98% or more, and attachment of fluff to guides is not found. The obtained fiber shows a preferable yarn properties such as a strength of 5.0 cN/dtex, elongation of 22%, boiling water shrinkage rate of 8.0%, and U % of 0.7%. Moreover, the b* value is 1.1 which hardly has a tincture of yellow and shows a preferable color tone.

By using the drawn yarn, a flat textile is manufactured in the same manner as the case of the example 1. In this case, yarn break or fluff is hardly occurs in the twisting process and weaving process and an excellent ability to smoothly pass through processing steps is shown.

The cloth is subjected to dyeing process in the same manner as the case of the example 1. The obtained cloth shows a excellent texture having less mechanical creak peculiar to polylactic acid fiber though it is ductile and soft. Moreover, the cloth has an excellent quality because it is excellent in color developability and has no dyeing unevenness. Furthermore, the dry friction solidity degree and wet friction solidity are fourth grade and the wearing resistance is excellent.

By using the dyed cloth, industrial cutting and industrial sewing are performed. There is no melt at the cloth cutting portion when the cloth is cut and soiling of a sewing machine needle is slight. Therefore, the cloth shows an excellent ability to pass through processing steps. As a result of performing a durability test in which a shirt is manufactured by using the cut cloth and wore for one month, an excellent product durability is shown because there is no fluff, whitening, or shine.

Example 5

A drawn yarn having 84 dtex and 36 filaments is obtained by performing melt spinning and drawing in the same manner as the case of the example 1 except to change a discharge quantity and setting the circumferential speed of first and second take-up rollers to 1,500 m/min and increasing the draw magnification to 2.4 times.

In spinning, the stay time from melting to spinning is approx. 12 min. Moreover, the spinning property is preferable and no yarn break or fluff is found.

Furthermore, the drawing property is preferable, the draw superiority ratio is 98% or more, and attachment of fluff to guides is not found. The obtained fiber shows preferable yarn properties such as strength of 3.5 cN/dtex, elongation of 41%, boiling water shrinkage rate of 7.0%, and U % of 1.3%. The b* value is 1.3 which is a preferable color tone because a tincture of yellow is hardly occurred.

By using the drawn yarn, a flat textile is manufactured in the same manner as the case of the example 1. In this case, yarn break or fluff is hardly occurred in the twisting process and weaving process and an excellent ability to smoothly pass through weaving process is shown.

The cloth is subjected to dyeing process in the same manner as the case of the example 1. The obtained cloth has a excellent texture having less mechanical creak peculiar to polylactic acid fiber though it is ductile and soft. Moreover, though the cloth is excellent in color developability, U % of a yarn is larger than the case of the example 1. Therefore, slight dyeing unevenness is found compared to the case of the example 1. Moreover, the cloth has fourth-grade dry friction solidity degree and wet friction solidity degree and is excellent in wearing resistance.

By using the dyed cloth, industrial cutting and industrial sewing are performed. There is no melt at the cloth cutting portion when the cloth is cut, soiling of a sewing machine needle is slight, and an excellent ability to smoothly pass through processing steps is shown. As a result of performing a durability test in which a shirt is manufactured by using the cut cloth and wore for one month, fluff, whitening, or shine is not occurred and excellent product durability is shown.

Example 6

A drawn yarn having 84 dtex and 144 filaments is obtained by melt spinning and drawing in the same manner as the case of the example 1 except to use polylactic acid in which the setting ratio between P1 and P2 becomes 1:1 in weight percent (2 wt % of EBA).

In spinning, the stay time of polymer from melting to spinning is approx. 10 min. Moreover, the spinning property is preferable and no yarn break or fluff is found.

Moreover, the drawing property is preferable, the draw superiority ratio is 98% or more, and attachment of fluff to guides is not found. The obtained fiber shows preferable yarn properties such as carboxyl end group concentration of 23 eq/t, temperature of crystallization in a temperature decrease Tc' of 126° C., strength of 3.4 cN/dtex, elongation of 39%, boiling water shrinkage rate of 7.5%, and U % of 0.9%. Moreover, the b* value is 1.2 which is a preferable color tone because a tincture of yellow is hardly present.

By using the drawn yarn, a flat textile is manufactured in the same manner as the case of the example 1. In this case, yarn break or fluff is hardly occurred in the twisting process and weaving process and an excellent ability to smoothly pass through weaving process is shown.

The cloth is subjected to dyeing processing in the same manner as the case of the example 1. The obtained cloth shows an excellent texture having less mechanical creak peculiar to polylactic acid though it is ductile and soft. Moreover, the cloth is excellent in color developability and has a excellent quality because it has no dyeing unevenness. Furthermore, the cloth has fourth-grade dry friction solidity degree and wet friction solidity degree and is excellent in wearing resistance.

By using the dyed cloth, industrial cutting and industrial sewing are performed. There is no melt at the cloth cutting portion when the cloth is cut, soiling of a sewing machine needle is slight, and an excellent ability to smoothly pass through processing steps is shown. As a result of performing a durability test in which a shirt is manufactured by using the cut cloth and wore for one month, there is no fluff, whitening, shine and excellent product durability is shown.

Example 7

A drawn yarn having 84 dtex and 12 filaments is obtained by performing melt spinning and drawing in the same manner as the case of the example 1 except to chip-blend polylactic acid (1 wt % of KBA) so that a weight ratio becomes P1:P4 becomes 3:1 in weight ratio and use a spinneret having 12 discharge holes (discharge hole diameter of 0.33 mm and hole depth of 0.75 mm).

In spinning, no smoking is found immediately under the spinneret. Moreover, the spinning property is preferable and no yarn break or fluff is found.

Moreover, the drawing property is preferable, the draw superiority ratio is 98% or more, and attachment of fluff to guides is not found. The obtained fiber shows preferable yarn properties such as carboxyl end group concentration of 25 eq/t, undetected the peak of crystallization in a temperature decrease, strength of 3.5 cN/dtex, elongation of 39%, boiling water shrinkage rate of 7.0%, and U % of 0.8%. Moreover, the b* value is 1.6 which is preferable color tone because a tincture of yellow is hardly occurred.

By using the drawn yarn, a flat textile is manufactured in the same manner as the case of the example 1. In this case, yarn break or fluff is hardly occurred in the twisting process and weaving process and an excellent ability to smoothly pass through weaving process is shown.

The cloth is subjected to dyeing process in the same manner as the case of the example 1. The obtained cloth shows excellent texture having less mechanical creak peculiar to polylactic acid fiber through it is ductile and soft. Moreover, the cloth is excellent in color develop ability and has an excellent quality because it has no dyeing unevenness. Furthermore, the cloth has fourth dry friction solidity degree and wet friction solidity degree and is excellent in wearing resistance.

By using the dyed cloth, industrial cutting and industrial sewing are performed. There is no melt at the cloth cutting portion when the cloth is cut, soiling of a sewing machine needle is slight, and excellent process passing property is shown. As a result of performing a durability test in which a shirt is manufactured by using the cut cloth and wore for one month, there is no fluff, whitening, or shine and excellent product durability is shown.

Example 8

A drawn yarn having 84 dtex and 12 filaments is obtained by performing melt spinning and drawing in the same manner as the case of the example 1 except to chip-blend polylactic acid so that P1:P5 becomes 3:1 in weight ratio (1 wt % of SS) and use a spinneret having 12 discharge holes (discharge hole diameter of 0.33 mm and hole depth of 0.75 mm).

In spinning, smoking is found immediately under the spinneret compared to the case of the example 1 through this does not become a problem. The spinning property is preferable, the number of yarn breaks is once/t, and no fluff is found.

Moreover, the drawing property is preferable though it is inferior to the case of the example 1. However, the draw superiority ratio is 97% and attachment of fluff to guides is slight. The obtained fiber shows preferable yarn properties such as carboxyl end group concentration of 24 eq/t, undetected the peak of crystallization in a temperature decrease, strength of 3.5 cN/dtex, elongation of 39%, boiling water shrinkage rate of 7.0%, and U % of 1.4%. Moreover, the b* value is 1.2 which is a preferable color tone because a tincture of yellow is hardly present.

By using the drawn yarn, a flat textile is manufactured in the same manner as the case of the example 1. In this case, yarn break or fluff is hardly occurred in the twisting process and weaving process and an excellent ability to smoothly pass through weaving process is shown.

The cloth is subjected to dyeing processing in the same manner as the case of the example 1. The obtained cloth shows ductile and soft excellent texture. However, mechanical creak peculiar to polylactic acid is slightly left. Moreover, though the cloth is excellent in color developability, a slight dyeing unevenness is found compared to the case of the example 1. Furthermore, though the dry friction solidity degree and wet friction solidity degree are third grade, which is an acceptable level, the wearing resistance is inferior to the case of the example 1.

By using the dyed cloth, industrial cutting and industrial sewing are performed. When compared to the case of the example 1, melt slightly occurs at the cloth cutting portion when the cloth is cut and soiling of a sewing machine needle is slightly found. However, a sufficient ability to smoothly pass through processing steps is shown. As a result of performing a durability test in which a shirt is manufactured by using the cut cloth and wore for one month, fluff, whitening, or shine is slight and sufficient product durability is shown though inferior to the case of the example 1.

TABLE 1

| | Examples | | | | | | | |
|---|---|---|---|---|---|---|---|---|
| | 1 | 2 | 3 | 4 | 5 | 6 | 7 | 8 |
| Smoothing agent type | EBA | EBA | EBA | EBA | EBA | EBA | KBA | SS |
| Melting point of smoothing agent (° C.) | 144 | 144 | 144 | 144 | 144 | 144 | 123 | 95 |
| Added quantity (weight %) | 1 | 4 | 0.3 | 1 | 1 | 2 | 1 | 1 |
| Spinning stagnation time | 10 | 10 | 10 | 6 | 12 | 10 | 10 | 10 |
| Spinning speed (m/minute) | 3000 | 3000 | 3000 | 5000 | 1500 | 3000 | 3000 | 3000 |
| b* value | 1.2 | 5.0 | 0.8 | 1.1 | 1.3 | 1.2 | 1.6 | 1.2 |
| Carboxyl end group concentration (eq/t) | 23 | 24 | 22 | 21 | 27 | 23 | 25 | 24 |
| Strength (cN/dtex) | 3.5 | 3.1 | 3.6 | 5.0 | 3.5 | 3.4 | 3.5 | 3.5 |
| Elongation (%) | 38 | 39 | 39 | 22 | 41 | 39 | 39 | 39 |
| Boiling-water shrinkage rate (%) | 7.0 | 6.0 | 7.5 | 8.0 | 7.0 | 7.5 | 7.0 | 7.0 |

TABLE 1-continued

| | Examples | | | | | | | |
|---|---|---|---|---|---|---|---|---|
| | 1 | 2 | 3 | 4 | 5 | 6 | 7 | 8 |
| U % Normal (%) | 0.7 | 1.5 | 0.7 | 0.7 | 1.3 | 0.9 | 0.8 | 1.4 |
| Exothermic peak of crystallization in a temperature decrease (° C.) | 126 | 127 | 121 | 128 | 120 | 126 | — | — |
| Solidity to dry friction (grade) | 4 | 5 | 3 | 4 | 4 | 4 | 4 | 3 |
| Solidity to wet friction (grade) | 4 | 5 | 3 | 4 | 4 | 4 | 4 | 3 |
| Dyeing unevenness | ◎ | ○ | ◎ | ◎ | ○ | ◎ | ◎ | ○ |
| Yarn breaks during spinning (frequency/t) | 0 | 0 | 0 | 0 | 0 | 0 | 0 | 1 |
| Draw superiority ratio (%) | 98 | 98 | 99 | 98 | 99 | 98 | 98 | 97 |
| Halt of loom (frequency/day/loom) | 2 | 1 | 1 | 2 | 2 | 2 | 2 | 3 |

Comparative Example 1

A drawn yarn having 84 dtex and 36 filaments was obtained by melt spinning and drawing similarly as that in Example 1, except that only P1 was used as polylactic acid.

In the spinning and drawing steps, fluffing occurred frequently around oil-supplying devices and a yarn guide for guiding yarns, resulting in poor yarn-making properties. Thus-obtained fiber exhibited carboxyl end group concentration 22 eq/t, strength 3.6 cN/dtex, elongation 39%, boiling-water shrinkage rate 7.5%, U %, and 0.7%, with no exothermic peak of crystallization in a temperature decrease detected. The fiber was 0.5 in b* value, substantially free of yellowing and, therefore, excellent in color tone.

Figure 2:
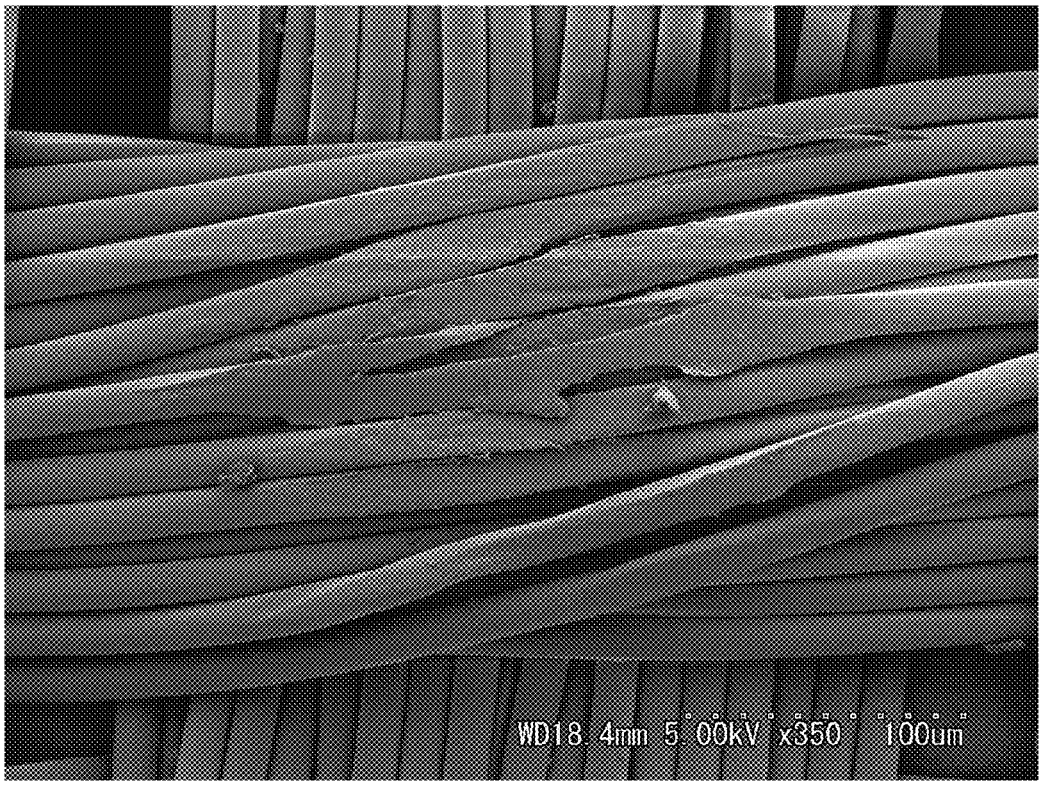
FIG. 2 shows the surface state of the conventional polylactic acid fibers after the test of solidity to friction.

The drawn yarn was used to prepare a flat textile similarly as that in Example 1, which was then dyed. Fluffing occurred frequently also in the warping and weaving process, resulting in poor weaving properties. Thus-obtained cloth had a mechanical squeaky touch specific to polylactic acid fibers and was inferior in feeling to that obtained in Example 1. Further, it showed the first grade of solidity to dry friction and also the first grade of solidity to wet friction, which was poor in wearing resistance. In addition, the surface of the cloth was observed with SEM after the wearing test, which showed significant wearing of the yarn (FIG. 2). Cracked polymers sticking on cotton cloth cause color transfer.

The dyeing cloth was subjected to industrial cut and industrial sewing. The cloth melted heavily at the cloth cut portion when cutting, and stain around sewing needles was significant, showing a very poor ability to smoothly pass through processing steps.

Thus-cut cloth was used to prepare shirts, which were, worn for a month to conduct a durability test. The test found these shirts to be significant in fluffing, whitening or shine by pressing and therefore poor in product durability.

Comparative Example 2

A drawn yarn having 84 dtex and 36 filaments was obtained by melt spinning and drawing similarly as that in Example 1, except that P1 and P2 were fed in weight ratio of 79:1 (EBA was 0.05 weight %) as polylactic acid.

In the spinning and drawing steps, fluff was found from time to time, resulting in a poor ability to smoothly pass through processing steps. Thus-obtained fiber exhibited carboxyl end group concentration 22 eq/t, strength 3.6 cN/dtex, elongation 39%, boiling-water shrinkage rate 7.5%, U %, and 0.7%, with no exothermic peak of crystallization in a temperature decrease detected. The fiber was 0.5 in b* value, substantially free of yellowing and, therefore, excellent in color tone.

The drawn yarn was used to prepare a flat textile similarly as that in Example 1, which was then dyed. Fluffing occurred from time to time also in the warping and weaving process, resulting in a poor ability to smoothly pass through processing steps. Thus-obtained cloth had a mechanical squeaky touch specific to polylactic acid fibers and was inferior to that obtained in Example 1 in feeling. Further, it showed the first grade of solidity to dry friction and also the second grade of solidity to wet friction, which was poor in wearing resistance.

The dyeing cloth was subjected to industrial cut and industrial sewing. The cloth melted heavily at the cloth cut portion when cutting, and stain around sewing needles was significant, showing a very poor ability to smoothly pass through processing steps.

Thus-cut cloth was used to prepare shirts, which were worn for a month to conduct a durability test. The test found these shirts to be significant in fluffing, whitening or shin by pressing and therefore poor in durability.

Comparative Example 3

A drawn yarn with trefoil cross section having 84 dtex and 36 filaments was obtained by melt spinning and drawing similarly as that in Example 2, except that only P3 (EBA was 7 weight %) was used as polylactic acid.

In the spinning step, smoke was released profusely immediately under a spinneret due to an excessive EBA content of 7 weight %, resulting in poor working conditions. Yarn breaks occurred frequently due to poor spinning properties.

Thus-obtained fiber exhibited carboxyl end group concentration 27 eq/t, temperature of crystallization in a temperature decrease Tc' 127° C., strength 2.8 cN/dtex, elongation 40%, boiling-water shrinkage rate 5.0%, U %, and 2.1%. Furthermore, the drawn yarn was 6.1 in b* value, which meant for the significant coloring; therefore, it could not be used as a garment.

The drawn yarn was used to prepare a flat textile similarly as that in Example 1 and then dyed. Thus-obtained cloth was heavily contaminated with dyeing unevenness and was inferior in quality.

Comparative Example 4

A drawn yarn having 84 dtex and 36 filaments was obtained by melt spinning and drawing similarly as that in Example 1, except that chips were blended so as to give P1:P6=3:1 by weight ratio as polylactic acid (BA was 1 weight %).

In the spinning step, smoke was released profusely immediately under a spinneret due to problems of heat resistance and sublimation property of BA, resulting in extremely poor working conditions.

Thus-obtained fiber exhibited carboxyl end group concentration 25 eq/t, strength 3.7 cN/dtex, elongation 40%, boiling-water shrinkage rate 7.0%, U %, and 1.8%, with no exothermic peak of crystallization in a temperature decrease detected.

The drawn yarn was used to prepare a flat textile similarly as that in Example 1, which was then dyed. Thus-obtained cloth was heavily contaminated with dyeing unevenness and was inferior in quality. Further, it showed the first grade of solidity to dry friction and also the first grade of solidity to wet friction, which was poor in wearing resistance.

The dyeing cloth was subjected to industrial cut and industrial sewing. The cloth melted heavily at the cloth cut portion when cutting, and stain around sewing needles was significant, showing a very poor ability to smoothly pass through processing steps.

Thus-cut cloth was used to prepare shirts, which were worn for a month to conduct a durability test. The test found these shirts to be significant in fluffing, whitening or shin by pressing and therefore poor in durability.

Comparative Example 5

A drawn yarn having 84 dtex and 36 filaments was obtained by melt spinning and drawing similarly as that in Example 1, except that chips were blended so as to give P1:P7=3:1 by weight ratio as polylactic acid (SA was 1 weight %), the discharge amount was changed, the first pulling roller was given to be 800 m/minute in circumferencial speed and the draw magnification was given to be 4 times.

In the spinning step, smoke was released profusely immediately under a spinneret due to problems of heat resistance and sublimation property of SA, resulting in extremely poor working conditions.

Thus-obtained fiber exhibited carboxyl end group concentration 26 eq/t, strength 3.7 cN/dtex, elongation 41%, boiling-water shrinkage rate 7.0%, U %, and 2.2%, with no exothermic peak of crystallization in a temperature decrease detected.

The drawn yarn was used to prepare a flat textile similarly as that in Example 1, which was then dyed. Thus-obtained cloth was heavily contaminated with dyeing unevenness and was inferior in quality. Further, it showed the first grade of solidity to dry friction and also the first grade of solidity to wet friction, which was poor in wearing resistance.

The dyeing cloth was subjected to industrial cut and industrial sewing. The cloth melted heavily at the cloth cut portion when cutting, and stain around sewing needles was significant, showing a very poor ability to smoothly pass through processing steps.

Thus-cut cloth was used to prepare shirts, which were worn for a month to conduct a durability test. The test found these shirts to be significant in fluffing, whitening or shin by pressing and therefore poor in durability.

TG (thermogravimetry) was conducted to determine the weight loss ratio caused by heating of SA, finding that it reduced by as much as 4.1% at 250° C. In contrast, in the case of EBA, a fatty acid bisamide, it reduced by only 0.5% at 250° C. It was, thus, revealed that fatty acid bisamide was better in heat resistance and lower in sublimation property than fatty acid monoamide.

TABLE 2

| | Comparative examples | | | | |
|---|---|---|---|---|---|
| | 1 | 2 | 3 | 4 | 5 |
| Smoothing agent type | — | EBA | EBA | BA | SA |
| Melting point of smoothing agent (° C.) | — | 144 | 144 | 110 | 100 |
| Added quantity (weight %) | — | 0.05 | 7 | 1 | 1 |
| Spinning stagnation time (minute) | 10 | 10 | 10 | 10 | 14 |
| Spinning speed (m/minute) | 3000 | 3000 | 3000 | 3000 | 800 |
| b* value | 0.5 | 0.5 | 6.1 | 3.8 | 4.2 |
| Carboxyl end group concentration (eq/t) | 22 | 22 | 27 | 25 | 26 |
| Strength (cN/dtex) | 3.6 | 3.6 | 2.8 | 3.7 | 3.7 |
| Elongation (%) | 39 | 39 | 40 | 40 | 41 |
| Boiling-water shrinkage rate (%) | 7.5 | 7.5 | 5.0 | 7.0 | 7.0 |
| U % Normal (%) | 0.7 | 0.7 | 2.1 | 1.8 | 2.2 |
| Exothermic peak of crystallization in a temperature decrease (° C.) | — | — | 121 | — | — |
| Solidity to dry friction (grade) | 1 | 1 | 5 | 1 | 1 |
| Solidity to wet friction (grade) | 1 | 2 | 5 | 1 | 1 |
| Dyeing unevenness | ◎ | ◎ | × | Δ | × |

Example 9

A drawn yarn having 84 dtex and 24 filaments was obtained by melt spinning and drawing similarly as that in Example 1, except that a spinneret having 24 discharge holes (0.28 mm in hole diameter and 0.75 mm in hole depth) was used and spinning oil agent (15% of emulsion concentration) containing a fatty acid ester-based smoothing agent at 65 weight % (isotridecyl stearate 35 weight %+octyl palmitate 30 weight %) was used.

The spinning property was favorable, and no yarn break or fluff was found.

The drawing properties were also favorable and the draw superiority ratio was 98% or greater. No fluff attached on guides. Thus-obtained fiber was excellent in yarn physical properties, exhibiting the strength 3.5 cN/dtex, elongation 40%, boiling-water shrinkage rate 7.0%, U %, and 0.7%. In addition, the fiber was 1.2 in b* value, substantially free of yellowing and, therefore, excellent in color tone.

The drawn yarn was used to prepare a flat textile similarly as that in Example 1. In the twisting and weaving processes, no yarn break or fluff was found at all, and the yarn exhibited an excellent ability to smoothly pass through the weaving process. Further, the yarn was superior to that obtained in Example 1 in terms of the weaving properties, and the weaving speed could be raised in order to increase the productivity.

The cloth was dyed similarly as that in Example 1. Thus-obtained cloth was flexible and soft, exhibiting an excellent feeling and lower mechanical squeaky touch specific to polylactic acid fibers. The cloth was also excellent in color developability and free of dyeing unevenness, exhibiting an excellent quality. In addition, it showed the fourth grade of solidity to dry friction and also the fourth grade of solidity to wet friction, which was excellent in wearing resistance.

The dyeing cloth was subjected to industrial cut and industrial sewing. The cloth did not melt at the cloth cut portion when cutting, and stain around sewing needles was insignificant, showing an excellent ability to smoothly pass through processing steps. Thus-cut cloth was used to prepare shirts, which were worn for a month to conduct a durability test. The test found these shirts to be free of fluffing, whitening or shin by pressing and therefore excellent in product durability.

Example 10

A drawn yarn having 84 dtex and 24 filaments was obtained by melt spinning and drawing similarly as that in Example 1, except that a spinneret having 24 discharge holes was used and spinning oil agent (15% of emulsion concentration) containing a fatty acid ester-based smoothing agent at 50 weight % (isotridecyl stearate 25 weight %+octyl palmitate 25 weight %) and mineral oil at 20 weight % was used.

The spinning property was favorable, and no yarn break or fluff was found.

The drawing property was also favorable and the draw superiority ratio was 98% or greater. No fluff attached on guides. Thus-obtained fiber was excellent in yarn physical properties, exhibiting the strength 3.5 cN/dtex, elongation 40%, boiling-water shrinkage rate 7.0%, U %, and 0.7%. In addition, the fiber was 1.2 in b* value, substantially free of yellowing and, therefore, excellent in color tone.

The drawn yarn was used to prepare a flat textile similarly as that in Example 1. In the twisting and weaving processes, no yarn break or fluff was found at all, and the yarn exhibited an excellent ability to smoothly pass through the weaving process. Further, the yarn was superior to that obtained in Example 1 in terms of the weaving properties, and the weaving speed could be raised in order to increase the productivity.

The cloth was dyed similarly as that in Example 1. Thus-obtained cloth was flexible and soft, exhibiting an excellent feeling and lower mechanical squeaky touch specific to polylactic acid fibers. The cloth was also excellent in the color developing property and free of dyeing unevenness, exhibiting an excellent quality. In addition, it showed the fourth grade of solidity to dry friction and also the fourth grade of solidity to wet friction, which was excellent in wearing resistance.

The dyeing cloth was subjected to industrial cut and industrial sewing. The cloth did not melt at the cloth cut portion when cutting, and stain around sewing needles was insignificant, showing an excellent ability to smoothly pass through processing steps. Thus-cut cloth was used to prepare shirts, which were worn for a month to conduct a durability test. The test found these shirts to be free of fluffing, whitening or shin by pressing and therefore excellent in product durability.

Example 11

A drawn yarn having 84 dtex and 36 filaments was obtained by melt spinning and drawing similarly as that in Example 2, except that a stationary kneader ("Hi Mixer" (10 stages) made by Toray Engineering Co., Ltd.) was built into the spin pack 4.

In the spinning step, polymer was stagnated for about 11 minutes from melting to spun sliver. The spinning property was favorable, and no yarn break or fluff was found.

The drawing property was also favorable and the draw superiority ratio was 99%. No fluff attached on guides. Thus-obtained fiber was excellent in yarn physical properties, exhibiting the strength 3.5 cN/dtex, elongation 40%, boiling-water shrinkage rate 7.0%, U %, and 0.8%. In addition, the fiber was 3.0 in b* value, substantially free of yellowing and, therefore, excellent in color tone.

The drawn yarn was used to prepare a flat textile similarly as that in Example 1. In the twisting and weaving processes, yarn break or fluff was hardly found, and the yarn exhibited an excellent ability to smoothly pass through the weaving process.

The cloth was dyed similarly as that in Example 1. Thus-obtained cloth was flexible and soft, exhibiting an excellent feeling and lower mechanical squeaky touch specific to polylactic acid fibers. The cloth was also excellent in the color developing property and free of dyeing unevenness, exhibiting an excellent quality. In addition, it showed the fourth grade of solidity to dry friction and also the fourth grade of solidity to wet friction, which was excellent in wearing resistance.

The dyeing cloth was subjected to industrial cut and industrial sewing. The cloth did not melt at the cloth cut portion when cutting, and stain around sewing needles was insignificant, showing an excellent ability to smoothly pass through processing steps. Thus-cut cloth was used to prepare shirts, which were worn for a month to conduct a durability test. The test found these shirts to be free of fluffing, whitening or shin by pressing and therefore excellent in product durability.

Example 12

A yarn was treated similarly as that in Example 1 up to the spinning step where entangling was imparted. Round-sectioned drawn yarn package 24 having 84 dtex and 36 filaments was obtained by subjecting the yarn to drawing and heat treatment between the first hot roller 21 operating at the circumferencial speed of 3000 m/minute and at 95° C. and the second roller 22 operating at the circumferencial speed of 4500 m/minute and at 135° C., and then winding up by using a winder 23 at winding tension of 0.12 cN/dtex.

In this instance, polymer was stagnated for about 10 minutes from melting to spun sliver. Smoke was hardly released immediately under a spinneret. The spinning property was favorable, and no yarn break or fluff was found.

Thus-obtained fiber was excellent in yarn physical properties, exhibiting the carboxyl end group concentration 22 eq/t, temperature of crystallization in a temperature decrease Tc' 126° C., strength 3.5 cN/dtex, elongation 40%, boiling-water shrinkage rate 7.0%, U %, and 0.7%. In addition, the fiber was 1.2 in b* value, substantially free of yellowing and, therefore, excellent in color tone.

The drawn yarn was used to prepare a flat textile similarly as that in Example 1. In the twisting and weaving processes, yarn break or fluff was hardly found, and the yarn exhibited an excellent ability to smoothly pass through the weaving process.

The cloth was dyed similarly as that in Example 1. Thus-obtained cloth was flexible and soft, exhibiting an excellent feeling and lower mechanical squeaky touch specific to polylactic acid fibers. The cloth was also excellent in the color developing property and free of dyeing unevenness, exhibiting an excellent quality. In addition, it showed the fourth grade of solidity to dry friction and also the fourth grade of solidity to wet friction, which was excellent in wearing resistance.

The dyeing cloth was subjected to industrial cut and industrial sewing. The cloth did not melt at the cloth cut portion when cutting, and stain around sewing needles was insignificant, showing an excellent ability to smoothly pass through processing steps. Thus-cut cloth was used to prepare shirts, which were worn for a month to conduct a durability test. The test found these shirts to be free of fluffing, whitening or shininess by pressing and therefore excellent in product durability.

TABLE 3

| | | Examples | | | |
|---|---|---|---|---|---|
| | | 9 | 10 | 11 | 12 |
| Method for addition | | Chip blend | Chip blend | Stationary kneader | Chip blend |
| Smoothing agent content in oil agent (wt %) | Fatty acid ester | 65 | 50 | 40 | 40 |
| | Mineral oil | 0 | 20 | 0 | 0 |
| Yarn making method | | POY-DT | POY-DT | POY-DT | DSD |
| Spinning speed (m/minute) | | 3000 | 3000 | 3000 | 3000 |
| b* value | | 1.2 | 1.2 | 3.0 | 1.2 |
| Carboxyl end group concentration (eq/t) | | 23 | 23 | 25 | 22 |
| Strength (cN/dtex) | | 3.5 | 3.5 | 3.5 | 3.5 |
| Elongation (%) | | 40 | 40 | 40 | 40 |
| Boiling-water shrinkage rate (%) | | 7.0 | 7.0 | 7.0 | 7.0 |
| U % Normal (%) | | 0.7 | 0.7 | 0.8 | 0.7 |
| Exothermic peak of crystallization in a temperature decrease (° C.) | | 126 | 126 | 128 | 126 |
| Solidity to dry friction (grade) | | 4 | 4 | 4 | 4 |
| Solidity to wet friction (grade) | | 4 | 4 | 4 | 4 |
| Dyeing unevenness | | ◎ | ◎ | ◎ | ◎ |
| Yarn breaks during spinning (frequency/t) | | 0 | 0 | 0 | 1 |
| Draw superiority ratio (%) | | 99 | 99 | 98 | — |
| Halt of loom (frequency/day/loom) | | 0 | 0 | 0 | 0 |

POY-DT: two-step process in which POY is once wound up and then drawn by using a drawing machine
DSD: spinning direct drawing method (one-step process)

Example 13

Chips (EBA was 1 weight %) were blended so as to give P1:P2=3:1 by weight ratio and fed into the hopper 1 of a spinning machine as polylactic acid, and melt at 220° C. through the extruder 2. Then, polymer was weighed by using the metering pump 3 inside the spin block 4 heated at 220° C., thus-melted polymer was introduced into the spin pack 5 and spun through the spinneret 6 having 136 Y-shaped holes. Thus-treated yarn bundle 8 was cooled and solidified with cooling air at wind speed of 25 m/minute and ambient temperature of 25° C. through the cooling device 7 and collected. Then, spinning oil agent (15% of emulsion concentration) containing 40 weight % of fatty acid ester-based smoothing agent (isotridecyl stearate 20 weight %+octyl palmitate 20 weight %) was applied through the oil supplying guide 9 at 1 weight % in relation to fiber, which was then taken off at 700 m/minute by using the first pulling roller 11 and the second pulling roller 12, so as to obtain the wind-up yarn package 14 by using the winder 13.

The undrawn yarn was subjected to 3.2-time drawing at 70° C., and then the drawn yarn was preliminarily heated through the heating roll kept at 130° C. and subjected to heating/air pressure treatment by using a crimping machine at 200° C., thereby giving crimp. Then, a crimped yarn made up of polylactic acid fibers having 2,000 dtex and 136 filaments was obtained by elongating the yarn to an extent that the crimp was not yet completely elongated and winding it up at winding tension 0.07 cN/dtex.

Then, the crimped yarn was tufted on a base made up of polylactic acid nonwoven fabric to give a level loop pile carpet. Thus-prepared raw fabric was dyed according to an ordinary method to obtain a carpet.

Example 14

A crimped yarn and a carpet made up of polylactic acid fibers were obtained by conducting steps similarly as that in Example 13, except that chips (EBA was 2 weight %) were blended so as to give P1:P2=1:1 by weight ratio and a spinneret for six-leaf cross section was used as polylactic acid.

Example 15

A crimped yarn and a carpet made up of polylactic acid fibers were obtained by conducting steps similarly as that in example 13, except that chips (EBA was 0.3 weight %) were blended so as to give P1:P2=92.5:7.5 by weight ratio as polylactic acid.

Example 16

A crimped yarn and a carpet made up of polylactic acid fibers having 1500 dtex and 180 filaments were obtained by conducting steps similarly as that in Example 13, except that P2 (EBA was 4 weight %) was used as polylactic acid, a spinneret with 180 holes was used and the discharge amount was changed.

Example 17

A crimped yarn and a carpet made up of polylactic acid fibers were obtained by conducting steps similarly as that in Example 13, except that a spinneret for round section was used.

Example 18

A crimped yarn and a carpet made up of polylactic acid fibers were obtained by conducting steps similarly as that in example 13, except that heating and air pressure of a crimping machine were done at the temperature changed to 220° C. to enforce crimping.

Example 19

A crimped yarn and a carpet made up of polylactic acid fibers were obtained by conducting steps similarly as that in example 13, except that chips (SS was 1 weight %) were blended so as to give P1:P4=75:25 by weight ratio as polylactic acid.

TABLE 4

| | | Examples | | | | | | |
|---|---|---|---|---|---|---|---|---|
| | | 13 | 14 | 15 | 16 | 17 | 18 | 19 |
| Smoothing agent type | | EBA | EBA | EBA | EBA | EBA | EBA | SS |
| Melting point of smoothing agent (° C.) | | 144 | 144 | 144 | 144 | 144 | 144 | 95 |
| Added quantity (weight %) | | 1 | 2 | 0.3 | 4 | 1 | 1 | 1 |
| Crimped yarn | b* value | 1.3 | 2.0 | 0.9 | 3.8 | 1.2 | 1.3 | 1.2 |
| | Carboxyl end group concentration (eq/t) | 22 | 22 | 22 | 22 | 22 | 22 | 25 |
| | Cross-sectional shape | 3 leaves | 6 leaves | 3 leaves | 3 leaves | round | 3 leaves | 3 leaves |
| | Degree of modified shape | 4.0 | 1.4 | 3.8 | 5.3 | 1.0 | 4.0 | 3.9 |
| | Single fiber fineness (dtex) | 14.7 | 14.7 | 14.7 | 8.3 | 14.7 | 14.7 | 14.7 |
| | Strength (cN/dtex) | 2.0 | 2.6 | 2.1 | 1.8 | 2.3 | 0.5 | 1.9 |
| | Elongation (%) | 37 | 35 | 38 | 40 | 36 | 30 | 39 |
| | Boiling-water shrinkage rate (%) | 6.0 | 7.8 | 7.0 | 9.1 | 5.9 | 11.8 | 8.2 |
| | Crimp elongation rate (%) | 13.0 | 15.1 | 11.2 | 14.9 | 10.3 | 42.3 | 12.4 |
| | Crimp unevenness | ○ | ◎ | Δ | ◎ | ○ | ○ | ○ |
| Carpet | Dyeing unevenness | ◎ | ○ | ○ | Δ | ◎ | ◎ | ○ |
| | Gloss | ○ | ◎ | ○ | ◎ | Δ | ○ | ○ |
| | Bulkiness | ○ | ◎ | ○ | ◎ | Δ | ◎ | ○ |
| | Feeling | ○ | ○ | Δ | ◎ | ○ | ○ | ○ |
| | Durability | ○ | — | — | ◎ | — | — | — |

Comparative Example 6

A crimped yarn and a carpet made up of polylactic acid fibers were obtained by conducting steps similarly as that in Example 13, except that only P1 was used as polylactic acid.

Comparative Example 7

A crimped yarn and a carpet made up of polylactic acid fibers were obtained by conducting steps similarly as that in Example 13, except that chips (EBA was 0.05 weight %) were blended so as to give P1:P2=98.7:1.3 by weight ratio as polylactic acid.

Comparative Example 8

A crimped yarn and a carpet made up of polylactic acid fibers having 1500 dtex and 180 filaments were obtained by conducting steps similarly as that in example 13, except that only P3 (EBA was 7 weight %) was used as polylactic acid, a spinneret with 180 holes was used and the discharge amount was changed. Smoke was released profusely when spinning, resulting in very poor working conditions. Further, in the spinning and drawing steps, yarn breaks occurred frequently, resulting in a poor ability to smoothly pass through processing steps.

TABLE 5

| | | Comparative examples | | |
|---|---|---|---|---|
| | | 6 | 7 | 8 |
| Smoothing agent type | | — | EBA | EBA |
| Melting point of smoothing agent (° C.) | | — | 144 | 144 |
| Added quantity (weight %) | | — | 0.05 | 7 |
| Crimped yarn | b*value | 0.5 | 0.6 | 6.5 |
| | Carboxyl end group concentration (eq/t) | 21 | 21 | 24 |
| | Cross-sectional shape | 3 leaves | 3 leaves | 3 leaves |
| | Degree of modified shape | 3.8 | 3.8 | 5.1 |

TABLE 5-continued

| | | Comparative examples | | |
|---|---|---|---|---|
| | | 6 | 7 | 8 |
| | Single fiber fineness (dtex) | 14.7 | 14.7 | 8.3 |
| | Strength (dN/dtex) | 1.9 | 2.0 | 1.7 |
| | Elongation (%) | 36 | 38 | 40 |
| | Boiling-water shrinkage rate (%) | 7.0 | 8.1 | 9.8 |
| | Crimp elongation rate (%) | 10.1 | 10.2 | 14.4 |
| | Crimp unevenness | × | × | ○ |
| Carpet | Dyeing unevenness | Δ | Δ | × |
| | Gloss | Δ | Δ | ◎ |
| | Bulkiness | ○ | ○ | ◎ |
| | Feeling | Δ | Δ | ◎ |
| | Durability | × | — | — |

Example 20

Chips (EBA was 1 weight %) were blended so as to give P1:P2=3:1 by weight ratio as polylactic acid, subjected to vacuum drying at 100° C. for 8 hours with agitation, and fed into the hopper 1. Thus-treated chips were melted and extruded through the extruder 2 at 220° C., and weighed by using the metering pump 3. The melted polymer was introduced into the spin pack 5 installed in the spin block 4 heated at 220° C., and spun through the spinneret 6 having 36 holes (0.3 mm in diameter and 0.5 mm in depth) to produce the yarn bundle 8 (FIG. 4). The polymer was stagnated for about 10 minute from melting to spun sliver. Smoke was hardly found immediately under a spinneret.

Thus-treated yarn bundle 8 was cooled and solidified with cooling air at wind speed of 25 m/minute and ambient temperature of 25° C. by using the cooling device 7 and collected through the oil feed guide 9. Then, spinning oil agent (15 weight % of emulsion concentration) containing 85 weight % of polyether-based smoothing agent [butanol (ethylene oxide/propylene oxide) random addition product, the weight ratio of ethylene oxide to propylene oxide=50/50 and the weight average molecular weight=1400] was applied to be 1.0 weight % on pure oil basis in relation to the whole of fiber weight. The yarn was entangled with airflow pressure of 0.05 MPa by using the entangling equipment 10, then taken off by using the first pulling roller 11 circumferencial speed, 5000 m/minute; (spinning speed, 5000 m/minute) and the second pulling roller 12 circumferential speed, 5025 m/minute and wound by using the winding machine 13 winding speed, 4925 m/minute; sharpness, 5.5° to obtain the wind-up yarn package 14 of partially oriented undrawn yarn (POY) and having 117 dtex and 366 filaments.

The spinning property was favorable, and no yarn break or fluff was found.

The draw friction false-twisting machine illustrated in FIG. 7 was used to feed the yarn bundle unreel from the wind-up yarn package 14 to the false-twist heater 27 contact type heated to 130° C. through the yarn guides 25*a*, 25*b* and 25*c* by using the feed roller 26 circumferencial speed 428.6 m/minute. Thereafter, the yarn bundle was twisted by using the twisting body 30 surface speed (D), 900 m/minute through the cooling plate 29 to which cooling water was circulated via the yarn guide 28. In this instance, the twisting body 30 was a three-axis friction false-twisting tool consisting of a total of 11 disks, in which the first through the third disks counted from the upstream of the direction of the yarn bundle were made with ceramic and the fourth through the tenth disks were made with urethane (hardness of 82 degree). Then, the yarn was taken off by using the drawing roller 31 (circumferencial speed 600 m/minute) and the false-twist package 34 having 84 dtex and 36 filaments was obtained through the delivery roller 32 (circumferencial speed 600 m/minute) and the yarn guides, 33*a* and 33*b*.

In the false-twist texturing step, the threading take-up property was good, and the yarn was stably processed, without attachment of tar or scum on the heater, the twisting body or various guides. In this instance, D/Y was 1.5, T1 was 0.15 cN/dtex, T2 was 0.23 cN/dtex and T2/T1 was 1.53.

Thus-treated false twisted yarn was used as a warp yarn and a weft yarn to prepare twill fabric (number of yarns/cm$^2$: warp yarn 95/2.54 cm and weft yarn 80/2.54 cm). Further, S twist (300 turns/m) was given to both the warp yarn and the weft yarn.

In the twisting and weaving processes, yarn break or fluff was hardly found, and the yarn exhibited an excellent ability to smoothly pass through the processing steps.

The cloth was dyed similarly as that in Example 1. Thus-obtained cloth was flexible and soft, exhibiting a sufficient growth, an excellent feeling and lower mechanical squeaky touch specific to polylactic acid fibers, and fewer dyeing unevenness. Evaluation of the wearing resistance showed that the cloth was excellent in wearing resistance without any significant change on the surface.

Example 21

False twisted yarn and a dyeing cloth made up of polylactic acid fibers were obtained by conducting steps similarly as that in Example 20, except that only P2 was used as polylactic acid.

In the spinning step, some smoke was released; however, the influence on the productivity and the working conditions was negligible.

The dyeing cloth was soft and flexible, exhibiting a sufficient growth. It was also free of dyeing unevenness and therefore excellent in quality. Evaluation of the wearing resistance showed that the cloth was excellent in wearing resistance without any significant change on the surface.

Example 22

False twisted yarn and a dyeing cloth were obtained by conducting steps similarly as that in Example 20, except that chips (EBA was 0.2 weight %) were blended so as to give P1:P2=20:1 by weight ratio as polylactic acid.

The false-twist texturing step was conducted without any serious problems, although yarn breaks were found several times during the step.

The dyeing cloth was soft and flexible, exhibiting a sufficient growth. It was also free of dyeing unevenness and therefore excellent in quality. Evaluation of the wearing resistance showed that the cloth was excellent in wearing resistance without any significant change on the surface.

Comparative Example 9

False twisted yarn and a dyeing cloth were obtained by conducting steps similarly as that in Example 20, except that only P1 was used as polylactic acid.

The false-twist texturing step was conducted without any serious problems, although yarn breaks were found several times during the step.

Thus-obtained false twisted yarn had non-untwisted at the frequency of 4/10 m, and was slightly poor in uniformity.

The dyeing cloth was soft and flexible, exhibiting a sufficient growth. However, evaluation of the wearing resistance showed scars on the surface and partial breakage. Thus, the cloth was impractical.

Comparative Example 10

False twisted yarn and a dyeing cloth were obtained by conducting steps similarly as that in Example 20, except that only P3 (EBA was 7 weight %) was used as polylactic acid.

In the spinning step, smoothing agents were heavily bled out, resulting in very poor working conditions.

The dyeing cloth was severely affected with dyeing unevenness and poor in quality. Evaluation of the wearing resistance showed some badly worn parts. Thus, the cloth was poor in wearing resistance.

TABLE 6

| | | Examples | | | Comparative examples | |
|---|---|---|---|---|---|---|
| | | 20 | 21 | 22 | 9 | 10 |
| Smoothing agent type | | EBA | EBA | EBA | — | EBA |
| Melting point of smoothing agent (° C.) | | 144 | 144 | 144 | — | 144 |
| Added quantity (weight %) | | 1 | 4 | 0.2 | — | 7.0 |
| Spinning stagnation time | | 10 | 10 | 10 | 10 | 10 |
| Spinning speed (m/minute) | | 5000 | 5000 | 5000 | 5000 | 5000 |
| POY boiling-water shrinkage rate (%) | | 15 | 15 | 15 | 15 | 15 |
| D/Y, VR | | 1.5 | 1.5 | 1.5 | 1.5 | 1.5 |
| $T_2/T_1$ | | 1.53 | 1.53 | 1.53 | 1.83 | 1.53 |
| Temperature on false-twist heater (° C.) | | 130 | 130 | 130 | 130 | 130 |
| False twisted yarn | b* value | 1.1 | 5.0 | 0.6 | 0.4 | 6.2 |
| | Carboxyl end group concentration (eq/t) | 23 | 24 | 22 | 22 | 27 |

TABLE 6-continued

| | | Examples | | | Comparative examples | |
|---|---|---|---|---|---|---|
| | | 20 | 21 | 22 | 9 | 10 |
| | Strength (cN/dtex) | 2.4 | 2.0 | 2.5 | 2.5 | 1.7 |
| | Elongation (%) | 23 | 24 | 22 | 21 | 26 |
| | Strength at 90° C. (cN/dtex) | 1.0 | 1.0 | 1.0 | 0.9 | 0.8 |
| | CR value (%) | 20 | 20 | 21 | 20 | 20 |
| | Non-untwisted yarn number (pieces/10 m) | 0 | 0 | 0 | 4 | 0 |
| | Boiling-water shrinkage rate (%) | 7.8 | 7.7 | 7.7 | 7.8 | 7.8 |
| | U % Normal (%) | 0.7 | 1.6 | 0.8 | 0.9 | 2.3 |
| Fabric | Solidity to dry friction (grade) | 4 | 4 | 3 | 1 | 5 |
| | Solidity to wet friction (grade) | 4 | 4 | 3 | 1 | 5 |
| | Dyeing unevenness | ◎ | ○ | ◎ | ◎ | × |

Example 23

False twisted yarn and a dyeing cloth were obtained by conducting steps similarly as that in Example 20, except that chips (KBA was 1.0 weight %) were blended so as to give P1:P4=3:1 by weight ratio as polylactic acid.

The yarn showed an excellent ability to smoothly pass through both the spinning and false-twist texturing steps.

The dyeing cloth was soft and flexible, exhibiting a sufficient growth. It was also free of dyeing unevenness and therefore excellent in quality. Evaluation of the wearing resistance showed that the cloth was excellent in wearing resistance without any significant change on the surface.

Example 24

False twisted yarn and a dyeing cloth were obtained by conducting steps similarly as that in Example 20, except that chips (SS was 1.0 weight %) were blended so as to give P1:P5=3:1 by weight ratio as polylactic acid.

The yarn showed an excellent ability to smoothly pass through both the spinning and false-twist texturing steps.

The dyeing cloth was soft and flexible, exhibiting a sufficient growth. It was also free of dyeing unevenness and therefore excellent in quality. Evaluation of the wearing resistance showed that the cloth was excellent in wearing resistance without any significant change on the surface.

Example 25

False twisted yarn and a dyeing cloth were obtained by conducting steps similarly as that in Example 20, except that in the spinning step the first pulling roller was operated at the circumferencial speed of 6000 m/minute, the second pulling roller at the circumferencial speed of 6030 m/minute and the wind-up machine at the wind-up speed of 5885 m/minute, while in the false-twist texturing step the feed roller was operated at the circumferencial speed of 480 m/minute and D/Y was 1.7.

Some yarn breaks were found in the spinning step.

The dyeing cloth was soft and flexible, exhibiting a sufficient growth. It was also free of dyeing unevenness and therefore excellent in quality. Evaluation of the wearing resistance showed that the cloth was excellent in wearing resistance without any significant change on the surface.

Example 26

False twisted yarn and a dyeing cloth were obtained by conducting steps similarly as that in Example 20, except that in the spinning step the first pulling roller was operated at the circumferencial speed of 4300 m/minute, the second pulling roller at the circumferencial speed of 4321 m/minute and the wind-up machine at the wind-up speed of 4235 m/minute, while in the false-twist texturing step the feed roller was operated at the circumferencial speed of 419.6 m/minute and D/Y was 1.4.

The yarn showed an excellent ability to smoothly pass through both the spinning and the false-twist texturing steps.

The dyeing cloth was soft and flexible, exhibiting a sufficient growth, with very few dyeing unevenness. Evaluation of the wearing resistance showed that the cloth was excellent in wearing resistance, with almost no change on the surface.

Example 27

False twisted yarn and a dyeing cloth were obtained by conducting steps similarly as that in Example 20, except that in the spinning step the first pulling roller was operated at the circumferencial speed of 4000 m/minute, the second pulling roller at the circumferencial speed of 4020 m/minute and the wind-up machine at the wind-up speed of 3940 m/minute, while in the false-twist texturing step the feed roller was operated at the circumferencial speed of 400 m/minute and D/Y was 1.3.

The yarn showed an excellent ability to smoothly pass through both the spinning and the false-twist texturing steps.

The dyeing cloth was soft and flexible, exhibiting an excellent growth, with very few dyeing unevenness. Evaluation of the wearing resistance showed that the cloth was excellent in wearing resistance, with almost no change on the surface.

Example 28

False twisted yarn and a dyeing cloth were obtained by conducting steps similarly as that in Example 20, except that in the spinning step the first pulling roller was operated at the circumferencial speed of 3500 m/minute, the second pulling roller at the circumferencial speed of 3518 m/minute and the wind-up machine at the wind-up speed of 3454 m/minute, while in the false-twist texturing step the feed roller was operated at the circumferencial speed of 333 m/minute and D/Y was 0.67.

In the spinning step, no yarn break or fluff was found, and the yarn showed an excellent ability to smoothly pass through the processing step.

In the false-twist texturing step, yarn breaks were frequently found on the false-twist heater. Further, the yarn bundle passed after the twisting body must have been treated at a high value of T2 or T2/T1 of 3.40. Otherwise, the yarn was untwisted at a higher frequency.

The dyeing cloth was slightly insufficient in growth, as compared with that obtained in Example 1. Evaluation of the wearing resistance revealed some scars on the surface. The cloth was inferior in wearing resistance to that obtained in Example 1 but at least acceptable.

TABLE 7

| | | Examples | | | | | |
|---|---|---|---|---|---|---|---|
| | | 23 | 24 | 25 | 26 | 27 | 28 |
| Smoothing agent type | | KBA | SS | EBA | EBA | EBA | EBA |
| Melting point of smoothing agent (° C.) | | 123 | 95 | 144 | 144 | 144 | 144 |
| Added quantity (weight %) | | 1 | 1 | 1 | 1 | 1 | 1 |
| Spinning stagnation time | | 10 | 10 | 9 | 11 | 12 | 12 |
| Spinning speed (m/minute) | | 5000 | 5000 | 6000 | 4300 | 4000 | 3500 |
| POY boiling-water shrinkage rate (%) | | 15 | 15 | 12 | 17 | 19 | 50 |
| D/Y, VR | | 1.5 | 1.5 | 1.7 | 1.4 | 1.3 | 0.67 |
| $T_2/T_1$ | | 1.52 | 1.53 | 1.40 | 1.93 | 2.25 | 3.40 |
| Temperature on false-twist heater (° C.) | | 130 | 130 | 130 | 130 | 130 | 130 |
| False twisted yarn | b* value | 1.5 | 1.1 | 1.0 | 1.3 | 1.4 | 1.5 |
| | Carboxyl end group concentration | 25 | 24 | 22 | 24 | 25 | 25 |
| | Strength (cN/dtex) | 2.3 | 2.2 | 2.5 | 2.4 | 2.4 | 2.4 |
| | Elongation (%) | 23 | 22 | 20 | 23 | 24 | 24 |
| | Strength at 90° C. (cN/dtex) | 1.0 | 1.0 | 1.1 | 0.9 | 0.7 | 0.35 |
| | CR value (%) | 21 | 20 | 23 | 19 | 23 | 9 |
| | Non-untwisted yarn number (pieces/10 m) | 0 | 0 | 0 | 1 | 3 | 7 |
| | Boiling-water shrinkage rate (%) | 7.9 | 7.8 | 6.5 | 7.6 | 6.5 | 7.0 |
| | U % Normal (%) | 0.8 | 1.5 | 0.5 | 0.9 | 1.0 | 1.2 |
| Cloth | Solidity to dry friction (grade) | 4 | 3 | 4 | 4 | 4 | 4 |
| | Solidity to wet friction (grade) | 4 | 3 | 4 | 4 | 4 | 4 |
| | Dyeing unevenness | ◎ | ○ | ◎ | ◎ | ◎ | ○ |

Example 29

Twist yarn and dyed cloth were obtained similarly as in Example 20, except that spinning oil containing polyether-based lubricant [butanol (ethylene oxide/propylene oxide) random addition product, the weight ratio of ethylene oxide to propylene oxide=50/50 and the weight average molecular weight=1400] at 65 weight % was used.

POY made up of polylactic acid fiber was 15% in boiling-water shrinkage rate.

The dyed cloth was excellent in puffiness, soft feeling and flexibility. The cloth was also substantially free of dyeing unevenness and favorable in quality. Evaluation of the cloth in wearing resistance showed an excellent result with a small change on the surface.

Example 30

Twist yarn and dyed cloth were obtained similarly as in Example 20, except that spinning oil containing polyether-based smoothing agent [butanol (ethylene oxide/propylene oxide) random addition product, the weight ratio of ethylene oxide to propylene oxide=50/50 and the weight average molecular weight=1400] at 45 weight % was used.

POY made up of polylactic acid fiber was 15% in boiling-water shrinkage rate.

The dyed cloth was provided with puffiness, soft feeling and flexibility and favorable in feeling, although some dyeing unevenness was found. Evaluation of the cloth in wearing resistance showed an excellent result with almost no change on the surface.

Example 31

Twist yarn and dyed cloth were obtained similarly as in Example 20, except that spinning oil consisting of 40 weight % of fatty acid ester-based smoothing agent (isotridecyl stearate 20 weight %+octyl palmitate 20 weight %), 15 weight % of mineral oil and 20 weight % of polyvalent alcohol ester (emulsifying agent) was used.

The twist yarn showed an ability to smoothly pass through the processing steps. However, oil agent attached to the surface of the twisted body, the false twist heater and the yarn guide during the continuous operation in the false-twist texturing process, it caused different crimp configurations between samples obtained at the beginning of the operation and those at the end of the operation.

Example 32

Twist yarn and dyed cloth were obtained similarly as in Example 20, except that D/Y was given to be 2.33.

The twist yarn showed an excellent ability to pass through the false-twist texturing process.

The dyed cloth was favorable in feelings such as puffiness and softness, although some dyeing unevenness was found. Evaluation of the cloth in wearing resistance showed an excellent result with almost no change on the surface.

Example 33

Twist yarn and dyed cloth were obtained similarly as in Example 20, except that D/Y was given to be 1.08.

In the false-twist texturing process, yarn breaks were found frequently between the twisted body and the draw roller. The dyed cloth was favorable in feelings such as puffiness and softness, although some dyeing unevenness was found on the cloth surface. Evaluation of the cloth in wearing resistance showed an excellent result with almost no change on the surface.

Example 34

Twist yarn and dyed cloth were obtained similarly as in Example 20, except that D/Y was given to be 0.67.

In the false-twist texturing process, yarn breaks were found frequently between the twisted body and the draw roller.

The dyed cloth was favorable in feelings such as puffiness, softness and flexibility.

TABLE 8

| | | Examples | | | | | |
|---|---|---|---|---|---|---|---|
| | | 29 | 30 | 31 | 32 | 33 | 34 |
| Smoothing agent content in oil agent (weight %) | Polyether | 65 | 45 | 0 | 85 | 85 | 85 |
| | Fatty acid ester | 0 | 0 | 40 | 0 | 0 | 0 |
| | Mineral oil | 0 | 0 | 15 | 0 | 0 | 0 |
| Spinning speed (m/minute) | | 5000 | 5000 | 5000 | 5000 | 5000 | 5000 |
| D/Y, VR | | 1.5 | 1.5 | 1.5 | 2.33 | 1.08 | 0.67 |
| $T_2/T_1$ | | 1.53 | 1.53 | 1.53 | 0.69 | 2.96 | 3.26 |
| Temperature on false twist heater (° C.) | | 130 | 130 | 130 | 130 | 130 | 130 |
| twist yarn | b* value | 1.1 | 1.1 | 1.1 | 1.1 | 1.1 | 1.1 |
| | Carboxyl end group amount | 23 | 23 | 23 | 23 | 23 | 23 |
| | Strength (cN/dtex) | 2.4 | 2.4 | 2.4 | 2.4 | 2.3 | 2.3 |
| | Elongation (%) | 23 | 23 | 22 | 24 | 20 | 20 |
| | Strength at 90° C. (cN/dtex) | 1.0 | 1.0 | 0.6 | 0.8 | 0.8 | 0.8 |
| | CR value (%) | 20 | 20 | 19 | 16 | 18 | 18 |
| | non-untwisted number (pieces/10 m) | 1 | 3 | 8 | 3 | 0 | 0 |
| | Boiling-water shrinkage rate (%) | 7.7 | 7.8 | 7.9 | 7.8 | 7.8 | 7.7 |
| | U % Normal (%) | 0.7 | 0.7 | 0.9 | 0.7 | 0.7 | 1.1 |
| Cloth | dry friction solidity degree (grade) | 4 | 4 | 4 | 4 | 3 | 2 |
| | wet friction solidity degree (grade) | 4 | 4 | 4 | 4 | 4 | 2 |
| | Dyeing unevenness | ◎ | ○ | Δ | ○ | ◎ | Δ |

Example 35

Twist yarn and dyed cloth were obtained similarly as in Example 20, except that the temperature on the false twist heater was given to be 95° C.

The twist yarn showed a favorable ability to smoothly pass through the twisting processing steps.

The dyed cloth was slightly inferior to that in Example 20 in softness and flexibility. Evaluation of the cloth in wearing resistance showed an excellent result with almost no change on the surface.

Example 36

Twist yarn and dyed cloth were conducted similarly as in Example 20, except that the temperature on the false twist heater was given to be 145° C.

The twist yarn showed an ability to pass through the false-twist texturing processing steps.

The dyed cloth was sufficient in puffiness and softness, free of dyeing unevenness and excellent in quality. Evaluation of the cloth in wearing resistance showed an excellent result with almost no change on the surface.

Example 37

Twist yarn and dyed cloth were obtained similarly as in Example 20, except that the temperature on the false twist heater was given to be 85° C.

The twist yarn showed an ability to smoothly pass through the false-twist texturing processing steps.

The dyed cloth was excellent in puffiness but showing some roughness. Evaluation of the cloth in wearing resistance showed an excellent result with almost no change on the surface.

Example 38

Twist yarn and dyed cloth were obtained similarly as in Example 20, except that the temperature on the false twist heater was given to be 155° C.

The twist yarn showed an ability to smoothly pass through the false-twist texturing processing steps.

The dyed cloth was inferior in puffiness, showing a paper-like feeling. However, evaluation of the cloth in wearing resistance showed an excellent result with almost no change in the surface.

TABLE 9

| | | Examples | | | |
|---|---|---|---|---|---|
| | | 35 | 36 | 37 | 38 |
| Spinning speed (m/minute) | | 5000 | 5000 | 5000 | 5000 |
| D/Y, VR | | 1.5 | 1.5 | 1.5 | 2.33 |
| $T_2/T_1$ | | 0.8 | 2.8 | 0.7 | 3.1 |
| Temperature on false twist heater (° C.) | | 95 | 145 | 85 | 155 |
| Twist yarn | b* value | 1.1 | 1.1 | 1.1 | 1.1 |
| | Carboxyl end group amount | 23 | 23 | 23 | 23 |
| | Strength (cN/dtex) | 2.5 | 2.0 | 2.4 | 1.9 |
| | Drawing ratio (%) | 22 | 21 | 22 | 18 |
| | Strength at 90° C. (cN/dtex) | 0.6 | 0.9 | 0.6 | 0.7 |
| | CR value (%) | 16 | 11.2 | 19 | 8 |
| | non-untwisted number (pieces/10m) | 0 | 0 | 0 | 3 |
| | Boiling-water shrinkage rate (%) | 14.0 | 5.0 | 17.0 | 4.8 |
| | U % Normal (%) | 0.7 | 0.9 | 1.2 | 1.4 |
| Cloth | dry friction solidity degree (grade) | 4 | 4 | 4 | 3 |
| | wet friction solidity degree (grade) | 4 | 4 | 4 | 4 |
| | Dyeing unevenness | ◎ | ◎ | ○ | ○ |

Example 39

Twist yarn and dyed cloth were obtained similarly as in Example 20, except that a belt nip type friction false-twisting tool was used as the twisting body and the belt made of nitrile butylene rubber (NBR) (hardness of 70 degrees) was used, setting the intersection angle to 100° and VR to 1.5.

The twist yarn showed an ability to smoothly pass through the false-twist texturing, twisting and weaving processing steps.

The dyed cloth was sufficient in puffiness, softness and flexibility, free of dyeing unevenness and excellent in quality. Evaluation of the cloth in wearing resistance showed an excellent result with almost no change on the surface.

Example 40

Twist yarn and dyed cloth were obtained similarly as in Example 20, except that discs made of urethane with hardness of 76 degrees (by type-A durometer hardness test by JIS K 6253) were used for the 4th through 10th disks mounted on the triaxial friction false-twist type disc false-twisting tool.

In the false-twist texturing process, continuous false twist texturing caused a significant wearing on the disk surface and the replacement cycle of the urethane disks was shorter than that in Example 20.

The twist yarn showed an ability to smoothly pass through the twisting and the weaving processing steps.

The dyed cloth was excellent in puffiness, softness and flexibility, free of dyeing unevenness and excellent in quality. Evaluation of the cloth in wearing resistance showed an excellent result with almost no change on the surface.

Example 41

Twist yarn and dyed cloth were obtained similarly as in Example 20, except that discs made of urethane with a hardness of 89 degrees (by type-A durometer hardness test of JIS K 6253) were used for the 4th through 10th disks mounted on the triaxial friction false-twist type disc false-twisting tool.

The twist yarn showed an ability to smoothly pass through the false-twist texturing, twisting and weaving processing steps.

The dyed cloth was excellent in puffiness, softness and flexibility and free of dyeing unevenness, although it was slightly inferior to that in Example 20 in quality due to glittering gloss resulted from deformation of the fiber cross section. Evaluation of the cloth in wearing resistance showed an excellent result with almost no change on the surface.

Example 42

Twist yarn and dyed cloth were obtained similarly as in Example 20, except that a belt nip type friction false-twisting tool was used as the twisting body of which the belt made of NBR (62-degree hardness) was used setting the intersection angle to 100° and VR to 1.5.

In the false-twist texturing process, continuous false-twist texturing caused a significant wearing on the belt surface and the replacement cycle of the belt was shorter than that in Example 20.

The twist yarn showed an ability to smoothly pass through the twisting and weaving processing steps The dyed cloth was excellent in growth, softness and flexibility and free of dyeing unevenness. Evaluation of the cloth in wearing resistance showed an excellent result with almost no change on the surface.

Example 43

Twist yarn and dyed cloth were obtained similarly as in Example 20, except that a belt nip type friction false-twisting tool was used as a twisting body of which the belt made of NBR (82-degree hardness) was used, setting the intersection angle to 100° and VR to 1.5.

In the false-twist texturing process, continuous false-twist texturing caused a significant wearing on the belt surface and the replacement cycle of the belt was shorter than that in Example 20.

The twist yarn showed an ability to smoothly pass through the twisting and weaving processing steps The dyed cloth was excellent in puffiness, softness and flexibility and free of dyeing unevenness although it was slightly inferior to that in Example 20 in quality due to glittering gloss resulted from deformation of the fiber cross section. Evaluation of the cloth in wearing resistance showed an excellent result with almost no change on the surface.

TABLE 10

| | | Examples | | | | |
|---|---|---|---|---|---|---|
| | | 39 | 40 | 41 | 42 | 43 |
| Spinning speed (m/minute) | | 5000 | 5000 | 5000 | 5000 | 5000 |
| $T_2/T_1$ | | 1.53 | 1.53 | 1.53 | 1.83 | 1.53 |
| Twisted body (type and material) | | Belt, NBR | Triaxial, Urethane | Triaxial, Urethane | Belt, NBR | Belt, NBR |
| Twisted body hardness (°) | | 70 | 76 | 89 | 62 | 82 |
| Twist yarn | B* value | 1.1 | 1.1 | 1.1 | 1.1 | 1.1 |
| | Carboxyl end group amount | 23 | 23 | 23 | 23 | 23 |
| | Strength (cN/dtex) | 2.5 | 2.4 | 2.4 | 2.5 | 2.4 |
| | Elongation (%) | 21 | 22 | 19 | 20 | 20 |
| | Strength at 90° C. (cN/dtex) | 1.0 | 1.0 | 1.0 | 1.0 | 1.0 |
| | CR value (%) | 20 | 21 | 20 | 20 | 20 |
| | non- untwisted number (pieces/10 m) | 0 | 0 | 0 | 0 | 0 |
| | Boiling-water shrinkage rate (%) | 7.8 | 7.8 | 7.8 | 7.8 | 7.8 |
| | U % Normal (%) | 0.7 | 0.7 | 0.7 | 0.7 | 0.7 |
| Cloth | dry friction solidity degree (grade) | 4 | 4 | 3 | 4 | 3 |
| | wet friction solidity degree (grade) | 4 | 4 | 4 | 4 | 4 |
| | Dyeing unevenness | ◎ | ◎ | ◎ | ◎ | ◎ |

Belt: belt nip type twisted body

NBR: nitrile butylene rubber

Three axis: triaxial-type twisted body

Example 44

Twist yarn and dyed cloth were obtained similarly as in Example 20, except that only P1 was supplied from the hopper 1 as a supply mode of raw material for polylactic acid fiber and ethylene-bis-stearamide (EBA) Alflow-H-50S made by NOF Corporation was supplied from a side feeder disposed at the middle of the extruder 2 so as to give an addition quantity of 1 weight %.

The twist yarn showed an ability to smoothly pass through the melt spinning, false-twist texturing, twisting and weaving processing steps. The polymer was held for about 9 minutes from the time when the EBA had been added to the time when it had been spun out.

Twist yarn of thus-obtained polylactic acid fiber was 0.7 in b* value, which was lower than that in Example 20. The boiling-water shrinkage rate, CR value and strength at 90° C. of the obtained twist yarn were 7.8%, 22% and 1.0 cN/dtex respectively, which showed an excellent dimensional stability, heat resistance and crimp properties. Further, the non-untwisted number was 0 knot/10 m, which showed an excellent crimp form in uniformity.

The dyed cloth was excellent in puffiness, softness and flexibility and free of dyeing unevenness. Evaluation of the cloth in wearing resistance showed an excellent result with almost no change on the surface.

Example 45

False twisted yarn and dyed cloth were obtained similarly as in Example 20, except that powder of ethylene-bis-stearamide (EBA) [Alflow H-50SJ made by NOF Corporation] was added to P1 in the drying process as a supply mode of raw material for polylactic acid fibers so as to give an addition quantity of 1 weight % and then fed into to the extruder 2.

During continuous operation in the melting and spinning processes, the amount of the smoothing agent varied in the range from 0.7 to 1.3 weight %. However, the twist yarn showed an ability to smoothly pass through the false-twist texturing, twisting and weaving processing steps.

The boiling-water shrinkage rate, CR value and strength at 90° C. of the twist yarn were 7.8%, 20% and 1.0 cN/dtex respectively, which showed an excellent dimensional stability, heat resistance and crimp form with excellent evenness. Further, the non-untwisted number was 0 piece/10 m, exhibiting an excellent crimp form in uniformity.

The dyed cloth was excellent in puffiness, softness and flexibility, with some dyeing unevenness. Evaluation of the cloth in wearing resistance showed an excellent result with almost no change on the surface.

Example 46

Twist yarn and a dyed cloth having 98 dtex and 36 filaments were obtained similarly as in Example 20, except that the discharge amount was changed and a contact type second heater was disposed between the draw roller 31 and the delivery roller 32 in the drawing and false twisting apparatus, setting the temperature of the second heater to 115° C. and the relaxation rate between the draw roller 31 and the delivery roller 32 to 20%.

The dyed cloth was flexible and soft, and showed an excellent feeling with lower squeakytouch specific to polylactic acid fibers at the same time. It was also free of dyeing unevenness and excellent in color developability. Evaluation of the cloth in wearing resistance showed an excellent result with almost no change on the surface.

The dyed cloth was put under industrial cut and industrial sewing. There was no melting at the cross section of the cloth when cutting with a minute stain on the sewing needles, showing an ability to smoothly pass through processing steps. Thus-cut cloth was used to prepare shirts, which were then put under a durability test after one month's wear. The test showed that these shirts were free of fluffing, whitening or discoloration by pressing and therefore excellent in durability.

Example 47

Twist yarn and a dyed cloth were obtained similarly as in Example 20, except that a non-contact type second heater was disposed between the draw roller 31 and the delivery roller 32 in the drawing and false-twisting apparatus, setting the temperature of the second heater to 200° C. and the delivery roller to 540 m/minute in peripheral speed.

The twist yarn showed an excellent ability to smoothly pass through the false-twist texturing, twisting and weaving processing steps.

The dyed cloth was excellent in softness and flexibility and free of dyeing unevenness. Evaluation of the cloth in wearing resistance showed an excellent result with almost no change on the surface.

TABLE 11

| | | Examples | |
|---|---|---|---|
| | | 46 | 47 |
| Spinning speed (m/minute) | | 5000 | 5000 |
| Type of second heater | | Contact type | Uncontact type |
| Temperature on second heater | | 115 | 200 |
| Draw roller speed (m/minute) | | 600 | 600 |
| Delivery roller speed (m/minute) | | 500 | 540 |
| Relaxation ratio | | 16.7 | 10.0 |
| Twist yarn | b* value | 1.3 | 1.5 |
| | Carboxyl end group amount | 23 | 23 |
| | Strength (dN/dtex) | 2.1 | 2.0 |
| | Elongation (%) | 30 | 27 |
| | Strength at 90° C. (dN/dtex) | 0.5 | 0.9 |
| | CR value (%) | 17 | 14 |
| | non-untwisted number (pieces/10m) | 0 | 0 |
| | Boiling-water shrinkage rate (%) | 5.7 | 5.0 |
| | U % Normal (%) | 0.9 | 0.8 |
| Cloth | dry friction solidity degree (grade) | 4 | 4 |
| | wet friction solidity degree (grade) | 4 | 4 |
| | Dyeing unevenness | ◎ | ◎ |

Example 48

Chips (EBA of 1 weight %) were blended so as to give a weight ratio of P1:P2=75:25 as polylactic acid, fed into a hopper of a spinning machine and melted in an extruder at 220° C., then spun out through a spinneret having 360 discharging holes at a discharge amount of 173 g/minute and drawn off by using the first draw-off roller (peripheral speed of 1000 m/minute) and the second draw-off roller. Similarly, a plurality of spun yarn bundles were doubled and placed into a container). The undrawn yarn was doubled to give a tow having 700,000 dtex, which was drawn by 3.2 times of the length in a hot water of 80° C., and then put under mechanical crimping process by means of a stuffer box running at nip pressure of 1.2 k g/cm$^2$(0.12 MPa) and pushing-in pressure of 0.7 kg/cm$^2$(0.07 MPa). Thereafter, the resultant was heat-treated for relaxation at 140° C., given oil agent and cut to obtain a polylactic acid short fiber SF1 having 1.5 dtex in single fiber fineness and 38 mm in fiber length. Thus-obtained short fiber was free of squeaky touch specific to polylactic acid fiber and its raw cotton was easily loosen when rubbed manually, and showed an excellent sliding properties.

Example 49

Polylactic acid short fiber SF2 were obtained similarly as in Example 48, except that chips (EBA of 2 weight %) were blended so as to give a weight ratio of P1:P2=1:1 as polylactic acid, a spinneret having 185 3-slit-type discharging holes was used so as to provide a fiber with a hollow cross section, and the discharge amount was changed to at 355 g/minute.

Thus-obtained polylactic acid short fiber was 25% in hollow ratio of the fiber cross section. The raw cotton had sliding properties, lightness and resilient feeling with suitable properties for cushion materials.

Example 50

Polylactic acid short fiber SF3 was obtained similarly as in Example 48, except that only P2 (EBA of 4 weight %) was used as polylactic acid, changing the discharge amount to 3.46 g/minute and the cut length to 51 mm.

Example 51

Polylactic acid short fiber SF4 was obtained similarly as in Example 48, except that chips (EBA of 0.3 weight %) blended to give a weight ratio of P1:P2=12.3:1 was used as polylactic acid.

Example 52

Polylactic acid short fiber SF5 was obtained similarly as in Example 48, except that chips (SS of 1 weight %) blended to give a weight ratio of P1:P3=75:25 was used as polylactic acid.

TABLE 12

| | | Examples | | | | |
|---|---|---|---|---|---|---|
| | | 48 | 49 | 50 | 51 | 52 |
| Raw cotton No. | | SF1 | SF2 | SF3 | SF4 | SF5 |
| Smoothing agent type | | EBA | EBA | EBA | EBA | SS |
| Melting point of smoothing agent (° C.) | | 144 | 144 | 144 | 144 | 95 |
| Addition quantity (weight %) | | 1 | 2 | 4 | 0.3 | 1 |
| Crimped yarn | B* value | 1.2 | 1.3 | 3.5 | 0.8 | 1.5 |
| | Carboxyl end group amount | 20 | 21 | 23 | 20 | 23 |
| | Single fiber fineness (dtex) | 1.5 | 6.0 | 3.0 | 1.5 | 1.5 |
| | Fiber length (mm) | 38 | 64 | 38 | 38 | 38 |
| | Strength (cN/dtex) | 3.9 | 3.9 | 3.6 | 3.8 | 3.7 |
| | Elongation (%) | 38 | 40 | 42 | 39 | 40 |
| | Boiling-water shrinkage rate (%) | 8.0 | 7.0 | 10.3 | 8.1 | 7.3 |
| | Exothermic peak of crystallization in a temperature decrease (° C.) | 125 | 123 | 125 | 120 | — |
| | Crimp number (ridge/25 mm) | 10 | 13 | 12 | 11 | 10 |
| | Crimp rate (%) | 25 | 28 | 27 | 24 | 23 |
| Sliding properties | | ○ | ○ | ◎ | Δ | ○ |

Comparative Example 11

Polylactic acid short fiber SF6 was obtained similarly as in Example 48, except that only P1 was used as polylactic acid. Thus-obtained polylactic acid short fiber was excellent in physical properties of yarn but had many crimp unevenness with higher squeaky touch specific to polylactic acid fibers and lower sliding properties.

Comparative Example 12

Polylactic acid short fiber SF7 was obtained similarly as in Example 48, except that chips (EBA of 0.05 weight %) blended to give a weight ratio of P1:P2=98.7:1.3 were used as polylactic acid. Thus-obtained polylactic acid short fiber was insufficient in sliding properties.

Comparative Example 13

Polylactic acid short fiber SF8 was obtained similarly as in Example 48, except that only P5 (EBA of 7 weight %) was used as polylactic acid.

During the spinning process, significant amount of smoke led the operating conditions extremely poor and caused frequent yarn breaks. Further, thus-obtained short fiber was higher in b* value and of yellowish color with little practicability for garments.

Comparative Example 14

Polylactic acid short fiber SF9 was obtained similarly as in Example 48, except that chips (SA of 1 weight %) blended to give a weight ratio of P1:P4=75:25 were used as polylactic acid.

Thus-obtained polylactic acid short fiber was insufficient in strength, higher in squeaky touch specific to polylactic acid fibers and inferior in sliding properties. It was also higher in b* value and of yellowish color.

TABLE 13

| | | Comparative examples | | | |
|---|---|---|---|---|---|
| | | 11 | 12 | 13 | 14 |
| Raw cotton No. | | SF6 | SF7 | SF8 | SF9 |
| Smoothing agent type | | — | EBA | EBA | SA |
| Melting point of smoothing agent (° C.) | | — | 144 | 144 | 100 |
| Addition quantity (weight %) | | — | 0.05 | 7 | 1 |
| Crimped yarn | B* value | 0.5 | 0.5 | 5.8 | 4.2 |
| | Carboxyl end group amount | 20 | 21 | 26 | 28 |
| | Single fiber fineness (dtex) | 1.5 | 1.5 | 1.5 | 1.5 |
| | Fiber length (mm) | 38 | 38 | 38 | 38 |
| | Strength (cN/dtex) | 3.8 | 3.7 | 3.5 | 3.2 |
| | Elongation (%) | 41 | 38 | 44 | 43 |
| | Boiling-water shrinkage rate (%) | 8.2 | 8.8 | 12.1 | 9.7 |

TABLE 13-continued

| | Comparative examples | | | |
|---|---|---|---|---|
| | 11 | 12 | 13 | 14 |
| Exothermic peak of crystallization in a temperature decrease (° C.) | — | — | 127 | — |
| Crimp number (ridge/25 mm) | 11 | 12 | 8 | 10 |
| Crimp rate (%) | 23 | 23 | 15 | 20 |
| Sliding properties | × | × | ◎ | × |

Example 53

Roving having a twisted number of 0.8 time/2.54 cm was obtained by feeding a sliver exclusively consisting of the polylactic acid short fiber SF1 into a drawing frame and putting under doubling and draft by using a roving machine. Then, the roving was fed into a fine spinning frame and treated under the condition of the draft rate of 35 times and the twisted number of 25 times/2.54 cm, and a spun yarn (yarn number 40 based on the English system) was obtained. Thus-obtained spun yarn showed very low thickness unevenness with 1.1 in coefficient I and 2.1 cN/dtex in strength with no problem for practical use. The yarn was substantially free of twist unevenness and fluff and also free of process unevenness with excellent quality.

The spun yarn was textured (circular knitting), dyed (use of disperse dye) and sewed according to a conventional method to prepare shirts. Thus-prepared shirts were free of dyeing unevenness and irritating feeling with an excellent appearance. Further, the shirts were put under a one-month wear durability test, which showed that they were free of fluffing, whitening or discoloration by pressing and therefore excellent in durability.

Example 54

Spun yarn with a cotton fiber content of 50 weight % was obtained similarly as in Example 53, except that a sliver exclusively consisting of polylactic acid short fiber SF1 and a sliver exclusively consisting of cotton fiber equivalent to the polylactic acid short fiber SF1 in weight per unit length were fed at the same time into the same drawing frame and mixed together.

Thus-prepared spun yarn was textured (circular knitting), dyed (use of disperse dye) and sewed according to a conventional method to prepare shirts. The shirts were free of irritating feeling with an excellent appearance even though natural dyeing unevenness specific to blended yarn. Further, the shirts were put under a durability test of one-month wear and showed that they were free of fluffing, whitening or discoloration by pressing and therefore excellent in durability.

Comparative Example 15

Spun yarn was obtained similarly as in Example 53, except that polylactic acid short fiber SF6 was used in place of polylactic acid short fiber SF1. Thus-obtained spun yarn was inferior to that in Example 48 in thickness unevenness, strength and quality. Further, shirts prepared by the spun yarn were at far below the practical use level with dyeing unevenness and irritating feeling. Further, the shirts were put under a one-month durability test and showed that they had fluffing, whitening or discoloration by pressing and were, therefore, inferior in durability.

Comparative Example 16

Spun yarn was obtained similarly as in Example 53, except that polylactic acid short fiber SF9 was used in place of polylactic acid short fiber SF1. The spun yarn was inferior to that in Example 53 in thickness unevenness, strength and quality.

The shirts prepared by the yarn had significant dyeing unevenness and irritating feeling and could not stand for practical use. Further, the shirts were put under a one-month durability test and showed that they had fluffing, whitening and discoloration by pressing and, therefore, inferior durability.

TABLE 14

| | | Examples | | Comparative examples | |
|---|---|---|---|---|---|
| | | 53 | 54 | 15 | 16 |
| Used short fiber | | SF1 | SF1/cotton | SF6 | SF9 |
| Spun yarn | Observed U % | 8.8 | 9.5 | 11.4 | 11.2 |
| | Theoretical U % | 8.0 | 8.0 | 8.0 | 8.0 |
| | coefficient I | 1.1 | 1.2 | 1.4 | 1.3 |
| | Strength (cN/dtex) | 2.1 | 2.0 | 1.4 | 1.3 |
| | Quality | ○ | ○ | Δ | × |

Example 55

Web of fabric weight of about 50 g/m$^2$ was obtained using polylactic acid short fiber SF3 as a raw material through an opening machine and a parallel carding machine. Then, nonwoven fabric was obtained by heat-treating the web at 170° C. for 60 seconds in a hot-air circulating type continuous dryer. Thus-obtained nonwoven fabric was favorable in physical properties such as a tensile strength of 14.2 k g/5 cm (139N/5 cm) and lower fiber density unevenness and had an excellent quality.

Comparative Example 17

Nonwoven fabric was obtained similarly as in Example 55, except that SF8 was used as polylactic acid short fiber. Thus-obtained nonwoven fabric was inferior in tensile strength (11.3 k g/5 cm (111N/5 cm)) to that in example 55, larger in fiber density unevenness and, therefore, inferior in quality. Since observation of webs in the course of manufacture revealed that there were many parts in the raw cotton where had not been detwisted, it is considered that a lower tensile strength and a larger density unevenness of the nonwoven fabric were due to a poor fiber opening.

Example 56

Polylactic acid short fiber SF2 was used as cotton pad to prepare a futon. The cotton pad exhibited very excellent properties such as bulkiness with 85 cm$^3$/g, compressibility of 55% and recovery rate of 93%. The short fiber was satisfactorily dispersed inside futon cover and showed a high quality as a final product.

Comparative Example 18

Futon was prepared similarly as in Example 56, except that SF6 was used as polylactic acid short fiber for the cotton pad.

The cotton pad was inferior in bulk properties with a low bulkiness of 47 $cm^3/g$, a compressibility of 63% and a recovery rate of 68%. Further, the cotton pad had not elasticity with harder feeling, as compared with that in Example 56.

Example 57

Board was prepared by mixing polylactic acid short fiber SF3 as a binder fiber and linen fiber cut to 51 mm in mean length as a main structure fiber at 50 weight % respectively in a blending machine to be put under heating, melting and compression molding. The board was 115 J/m in bending strength with favorable physical properties.

Comparative Example 19

Board was prepared similarly as in Example 57, except that SF6 was used as a binder fiber in place of polylactic acid short fiber SF3. The board was 78 J/m in bending strength and inferior in durability compared to that in Example 57.

DESCRIPTION OF SYMBOLS

1: Hopper
2: Extruder
3: Weighing pump
4: Fiber spinning block
5: Fiber spinning pack
6: Spinneret
7: Cooling device
8: Yarn-thread
9: Oil feed guide
10: Entangling system
11: First take-up roller
12: Second take-up roller
13: Winder
14: Wound yarn package
15: Feed roller
16: First hot roller
17: Second hot roller
18: Cold roller
19: Winder
20: Drawn yarn package
21: First hot roller
22: Second hot roller
23: Winder
24: Drawn yarn package
25*a* to 25*c*: Yarn guide
26: Feed roller
27: False-twist texturing heater
28: Yarn guide
29: Cooling plate
30: Twisted body
31: Drawing roller
32: Delivery roller
33*a* to 33*b*: Yarn guide
34: False-twist textured yarn package

What is claimed is:

1. Polylactic acid fiber comprising a polylactic acid containing fatty acid bisamide in an amount of 0.1 to 5 weight % in relation to the whole of fiber, said fatty acid bisamide having a melting point of 100° C. or higher and being selected from the group consisting of ethylene-bis(stearamide), ethylene-bis(oleamide), ethylene-bis(erucamide) and m-xylylene-bis(stearamide), wherein said fiber is produced by a melt-spinning method and has a b* value in fiber color system of L*a*b* in the range of −1 to 5 and a single fiber fineness of 0.1-10 dtex, and the polylactic acid is 40 eq/t or less in carboxyl end group amount.

2. The polylactic acid fiber according to claim 1, wherein fiber-constituting polylactic acid is from 50,000 to 500,000 in weight-average molecular weight.

3. The polylactic acid fiber according to claim 1, of which the strength is 2.0 cN/dtex or higher.

4. The polylactic acid fiber according to claim 1, of which the elongation is in the range of 15 to 70%.

5. The polylactic acid fiber according to claim 1, of which the boiling-water shrinkage rate is in the range of 0 to 20%.

6. The polylactic acid fiber according to claim 1, of which the polylactic acid has an exothermic peak of crystallization in a temperature decrease at 100° C. or higher.

7. The polylactic acid fiber according to claim 1, which has a form of filament.

8. The polylactic acid fiber according to claim 7, wherein said filament is 1.5% or less in thickness unevenness of U %.

9. The polylactic acid fiber according to claim 7, which is not treated by crimping and has on the surface thereof at least one type of smoothing agent selected from fatty acid ester, polyvalent alcohol ester, ether ester, silicone and mineral oil.

10. The polylactic acid fiber according to claim 7, which has crimps made by fluid texturing.

11. The polylactic acid fiber according to claim 10, which has on the surface thereof at least one type of smoothing agent selected from fatty acid ester, polyvalent alcohol ester, ether ester, silicone and mineral oil.

12. The polylactic acid fiber according to claim 10, having the following properties:

crimping elongation rate: 3 to 35%
single fiber fineness: 3 to 35 dtex
degree of modified cross section: 1.1 to 8.

13. The polylactic acid fiber according to claim 7, which has crimps made by false twist texturing.

14. The polylactic acid fiber according to claim 13, which has on the surface thereof a smoothing agent mainly constituted with polyether.

15. The polylactic acid fiber according to claim 14, wherein said polyether is a compound or a derivative thereof in which alkylene oxide with the carbon number of 2 to 4 is added through copolymerization to alcohol having one or more of hydroxyl groups within molecule.

16. The polylactic acid fiber according to claim 13, having the following properties;

strength at 90° C.≧0.4 cN/dtex,
CR≧10%,
non-untwisted number≦3 pieces/10 m.

17. The polylactic acid fiber according to claim 16, wherein the boiling-water shrinkage rate is 15% or lower.

18. The polylactic acid fiber according to claim 1, which has a form of staple fiber.

19. The polylactic acid fiber according to claim 18, which has on the surface thereof at least one type of smoothing agent selected from fatty acid ester, polyvalent alcohol ester, ether ester, silicone and mineral oil.

20. The polylactic acid fiber according to claim 18, having the following properties;

crimp number≧6/25 mm,
crimping rate≧10%.

21. A yarn package wherein the filament according to claim 7 is wound.

22. The yarn package according to claim 21, wherein the saddle of the package is 7 mm or lower.

23. A fiber product in which the polylactic acid fiber described in claim 1 is used at least partially.

24. The fiber product according to claim 23, in which the fiber product is a knitting fabric.

25. The fiber product according to claim 23, in which the fiber product is a woven fabric.

26. The fiber product according to claim 23, in which the fiber product is a nonwoven fabric.

27. The fiber product according to claim 23, in which the fiber product is a carpet.

28. The fiber product according to claim 23, wherein the solidity to dry friction is third grade or higher and the solidity to wet friction is second grade or higher.

* * * * *